US010465930B2

(12) United States Patent
Daniels

(10) Patent No.: US 10,465,930 B2
(45) Date of Patent: Nov. 5, 2019

(54) ROOF VENT WITH AN INTEGRATED FAN

(71) Applicant: Gregory S. Daniels, Santa Rosa, CA (US)

(72) Inventor: Gregory S. Daniels, Santa Rosa, CA (US)

( * ) Notice: Subject to any disclaimer, the term of this patent is extended or adjusted under 35 U.S.C. 154(b) by 706 days.

(21) Appl. No.: 14/515,938

(22) Filed: Oct. 16, 2014

(65) Prior Publication Data

US 2015/0253021 A1 Sep. 10, 2015

Related U.S. Application Data

(60) Provisional application No. 62/043,988, filed on Aug. 29, 2014, provisional application No. 61/948,950, filed on Mar. 6, 2014.

(51) Int. Cl.

| | |
|---|---|
| ***F24F 7/02*** | (2006.01) |
| ***F24F 13/32*** | (2006.01) |
| ***E04D 1/30*** | (2006.01) |

(52) U.S. Cl.

CPC ..... *F24F 7/025* (2013.01); *E04D 1/30* (2013.01); *F24F 13/32* (2013.01); *E04D 2001/309* (2013.01); *Y10T 29/49623* (2015.01)

(58) Field of Classification Search

CPC .... F24F 7/02; F24F 7/025; E04D 1/30; E04D 13/17; E04D 2001/309; Y10T 29/49623

See application file for complete search history.

(56) References Cited

U.S. PATENT DOCUMENTS

| | | | |
|---|---|---|---|
| D30,059 | S | 1/1899 | Tracy |
| 2,299,317 | A | 10/1942 | Fink |

(Continued)

FOREIGN PATENT DOCUMENTS

| | | |
|---|---|---|
| DE | 28 04 301 | 2/1979 |
| DE | 198 23 356 | 11/1999 |

(Continued)

OTHER PUBLICATIONS

Flat-Type Vent. Formfomts.com[online] 1 page. Designed/built 2008 [retrieved on Feb. 12, 2015]. <https://www.formfonts.com/3D-Model/11 030/1 /b3020-roof-openings/b3020-roof-openings/b3020-roof-openings/b3020-roof-openings/b3020-roof-openings/ohagins-concrete-tile-vent-type-flatl>.

(Continued)

*Primary Examiner* — Avinash A Savani

*Assistant Examiner* — Martha M Becton

(74) *Attorney, Agent, or Firm* — Knobbe, Martens, Olson & Bear, LLP

(57) ABSTRACT

A roof vent member with an integrated fan assembly is disclosed. The roof vent member includes an upper plate having fasteners that extend downward below a roof deck when installed to allow for access to the fan assembly from underneath the roof deck. Thus, the fan assembly may be installed, removed, replaced, maintained, etc. from underneath the roof without having to get on the roof or otherwise disrupt the roof envelope. The roof vent may include the upper plate, a subflashing, the fan assembly, sealing elements, screens, and other features. A secondary roof vent member may be included which may include solar panels. Associated methods of using the vent members, such as installing, removing, and replacing the vent member or various components thereof, are further disclosed.

25 Claims, 28 Drawing Sheets

(56) References Cited

U.S. PATENT DOCUMENTS

D134,477 S 12/1942 Leslie
2,551,223 A 5/1951 Schneider
2,638,835 A 5/1953 Strawsine
2,692,548 A 10/1954 Knorr
2,733,649 A 2/1956 Le Barron
3,027,090 A 3/1962 Zerhan, Jr.
3,083,633 A 4/1963 Hochberg
D204,715 S 5/1966 Martin
3,376,164 A 4/1968 Bachwansky
3,459,597 A 8/1969 Baron
D215,940 S 11/1969 Kahn
D217,610 S 5/1970 Stoop
3,553,030 A 1/1971 Lebrun
3,658,596 A 4/1972 Osborne
3,769,091 A 10/1973 Leinkram et al.
3,888,697 A 6/1975 Bogus et al.
3,895,467 A 7/1975 Clement
3,951,336 A 4/1976 Miller et al.
4,040,867 A 8/1977 Forestieri et al.
4,051,999 A 10/1977 Granger et al.
D247,510 S 3/1978 Kujawa, Jr.
4,083,097 A 4/1978 Anagnostou et al.
4,097,308 A 6/1978 Klein et al.
D249,158 S 8/1978 Morrow
4,108,580 A 8/1978 Felter
4,189,881 A 2/1980 Hawley
D254,442 S 3/1980 Cervone
4,201,121 A 5/1980 Brandenburg, Jr.
4,224,081 A 9/1980 Kawanura et al.
4,228,729 A 10/1980 Messick
4,239,555 A 12/1980 Scharkack et al.
4,251,026 A 2/1981 Siegel et al.
D259,138 S 5/1981 Giles
D261,803 S 11/1981 Bohanon, Jr.
4,314,548 A 2/1982 Hanson
4,382,435 A 5/1983 Brill-Edwards
4,383,129 A 5/1983 Gupta et al.
4,404,958 A 9/1983 Boettcher
4,418,685 A 12/1983 Frazier
4,432,273 A 2/1984 Devitt
4,433,200 A 2/1984 Jester et al.
D276,261 S 11/1984 Shaftner
4,485,264 A 11/1984 Izu et al.
4,498,267 A 2/1985 Beck
4,501,194 A * 2/1985 Brown ..... F24F 7/025 454/354
4,510,851 A * 4/1985 Sarnosky ..... F04D 29/646 454/346
4,574,160 A 3/1986 Cull et al.
4,594,940 A * 6/1986 Wolbrink ..... F24F 7/013 454/346
4,602,739 A 6/1986 Sutton, Jr.
D285,829 S 9/1986 Lock
4,625,469 A 12/1986 Gentry et al.
4,633,769 A 1/1987 Milks
4,651,805 A 3/1987 Bergeron, Jr.
4,677,903 A 7/1987 Mathews, III
4,692,557 A 9/1987 Samuelson et al.
4,759,272 A 7/1988 Zaniewski
4,803,816 A 2/1989 Klober
4,843,794 A 7/1989 Holtgreve
4,850,166 A 7/1989 Taylor
4,860,509 A 8/1989 Laaly et al.
4,965,971 A 10/1990 Jean-Jacques et al.
4,977,818 A 12/1990 Taylor et al.
4,986,469 A 1/1991 Sutton, Jr.
D318,109 S 7/1991 Sullivan et al.
5,048,255 A 9/1991 Gonzales
5,049,801 A 9/1991 Potter
5,060,444 A 10/1991 Paquette
5,070,771 A 12/1991 Mankowski
5,078,047 A * 1/1992 Wimberly ..... E04D 13/17 454/366
5,092,939 A 3/1992 Nath et al.
5,094,697 A 3/1992 Takabayashi et al.
5,121,583 A 6/1992 Hirai et al.
5,131,200 A 7/1992 McKinnon
5,131,888 A 7/1992 Adkins, II
5,133,810 A 7/1992 Morizane et al.
D332,139 S 12/1992 Courchesne
5,176,758 A 1/1993 Nath et al.
5,228,925 A 7/1993 Nath et al.
5,232,518 A 8/1993 Nath et al.
5,238,519 A 8/1993 Nath et al.
D342,129 S 12/1993 Goetz et al.
5,273,608 A 12/1993 Nath
5,296,043 A 3/1994 Kawakami et al.
5,316,592 A 5/1994 Dinwoodie
5,326,318 A 7/1994 Rotter
5,333,783 A 8/1994 Catan
5,364,026 A 11/1994 Kundert
5,385,848 A 1/1995 Grimmer
5,391,235 A 2/1995 Inoue
5,409,549 A 4/1995 Mori
5,419,781 A 5/1995 Hamakawa et al.
5,437,735 A 8/1995 Younan et al.
5,480,494 A 1/1996 Inoue
5,486,238 A 1/1996 Nakagawa et al.
5,505,788 A 4/1996 Dinwoodie
5,528,229 A 6/1996 Mehta
5,549,513 A 8/1996 Thomas et al.
D374,927 S 10/1996 Chabot et al.
5,575,861 A 11/1996 Younan et al.
5,591,080 A 1/1997 Ward
5,602,457 A 2/1997 Anderson et al.
5,620,368 A 4/1997 Bates et al.
5,636,481 A 6/1997 De Zen
D380,823 S 7/1997 LaZar
5,651,226 A 7/1997 Archibald
5,672,101 A 9/1997 Thomas
5,697,192 A 12/1997 Inoue
5,697,842 A 12/1997 Donnelly
5,706,617 A 1/1998 Hirai et al.
5,722,887 A 3/1998 Wolfson et al.
5,738,581 A 4/1998 Rickert et al.
5,740,636 A 4/1998 Archard
5,746,653 A 5/1998 Palmer et al.
5,746,839 A 5/1998 Dinwoodie
5,766,071 A 6/1998 Kirkwood
D397,431 S 8/1998 Meyer
5,800,631 A 9/1998 Yamada et al.
5,816,909 A 10/1998 Wunder
D403,755 S 1/1999 Liang
5,879,232 A * 3/1999 Luter, II ..... F04D 25/08 454/349
D408,514 S 4/1999 Horng
5,890,322 A * 4/1999 Fears ..... E04D 13/0762 340/580
D409,741 S 5/1999 Yuen-Ming
5,968,287 A 10/1999 Nath
5,990,414 A 11/1999 Posnansky
6,005,236 A 12/1999 Phelan et al.
6,008,450 A 12/1999 Ohtsuka et al.
6,036,102 A 3/2000 Pearson
6,050,039 A 4/2000 O'Hagin
6,051,774 A 4/2000 Yoshida et al.
D424,186 S 5/2000 Dodson
D424,672 S 5/2000 Nanjo
6,061,977 A 5/2000 Toyama et al.
6,061,978 A 5/2000 Dinwoodie et al.
6,077,159 A 6/2000 Clayton
6,105,317 A 8/2000 Tomiuchi et al.
6,129,628 A * 10/2000 O'Hagin ..... F24F 7/02 454/366
6,155,006 A 12/2000 Mimura et al.
6,220,956 B1 * 4/2001 Kilian ..... F24F 11/0001 454/239
D442,273 S 5/2001 Pestell
6,241,602 B1 6/2001 Allen
6,242,685 B1 6/2001 Mizukami et al.
6,243,995 B1 6/2001 Reeves et al.
D444,869 S 7/2001 Yip
6,294,724 B1 9/2001 Sasaoka et al.
6,306,030 B1 10/2001 Wilson

(56) References Cited

U.S. PATENT DOCUMENTS

D450,378 S 11/2001 Minakuchi
6,311,436 B1 11/2001 Mimura et al.
6,336,304 B1 1/2002 Mimura et al.
6,340,403 B1 1/2002 Carey et al.
6,365,824 B1 4/2002 Nakazima et al.
6,380,477 B1 4/2002 Curtin
D457,234 S 5/2002 O'Hagin et al.
D458,391 S 6/2002 O'Haqin et al.
D458,392 S 6/2002 O'Haqin et al.
6,415,559 B1 7/2002 Reeves et al.
6,418,678 B2 7/2002 Rotter
6,439,466 B2 8/2002 Fikes
6,447,390 B1 * 9/2002 O'Hagin ..... E04D 1/30 454/250
6,453,629 B1 9/2002 Nakazima et al.
6,459,032 B1 10/2002 Luch
6,491,579 B1 * 12/2002 O'Hagin ..... E04D 1/30 454/250
6,501,013 B1 12/2002 Dinwoodie
6,541,693 B2 4/2003 Takada et al.
6,553,729 B1 4/2003 Nath et al.
6,606,830 B2 8/2003 Nagao et al.
D479,885 S 9/2003 O'Hagin et al.
6,695,692 B1 * 2/2004 York ..... E04D 13/0325 454/199
D489,834 S 5/2004 Weston
6,729,081 B2 5/2004 Nath et al.
6,730,841 B2 5/2004 Heckeroth
6,767,762 B2 7/2004 Guha
6,799,742 B2 10/2004 Nakamura et al.
D503,156 S 3/2005 Provenzano
6,870,087 B1 3/2005 Gallagher
D503,790 S 4/2005 Dodge et al.
D504,172 S 4/2005 O'Hagin
6,875,914 B2 4/2005 Guha et al.
D505,195 S 5/2005 Snyder
6,928,775 B2 8/2005 Banister
6,941,706 B2 9/2005 Austin et al.
D512,774 S 12/2005 O'Hagin et al.
D518,158 S 3/2006 Cho et al.
D519,219 S 4/2006 Dodge et al.
D520,149 S 5/2006 Dodge et al.
7,044,852 B2 5/2006 Horton
7,053,294 B2 5/2006 Tuttle et al.
7,097,557 B2 8/2006 Kutschman
D527,813 S 9/2006 Dodge et al.
D527,836 S 9/2006 O'Hagin
7,101,279 B2 9/2006 O'Hagin et al.
D536,778 S 2/2007 O'Hagin
D537,519 S 2/2007 Sigillo
7,176,543 B2 2/2007 Beernink
7,178,295 B2 2/2007 Dinwoodie
D538,422 S 3/2007 Hooijaaijers et al.
7,250,000 B2 7/2007 Daniels, II
D549,316 S 8/2007 O'Hagin et al.
D555,237 S 11/2007 O'Hagin
7,320,774 B2 1/2008 Simmons et al.
D562,440 S 2/2008 Negrao et al.
D562,993 S 2/2008 Shepherd et al.
7,365,266 B2 4/2008 Heckeroth
D578,633 S 10/2008 Schluter et al.
D579,096 S 10/2008 Guzorek
D580,542 S 11/2008 Miyake
D582,905 S 12/2008 Takisawa et al.
7,469,508 B2 12/2008 Ceria
7,470,179 B1 * 12/2008 Ritter ..... F24F 13/084 454/349
D588,255 S 3/2009 Daniels
D588,256 S 3/2009 Daniels
D589,134 S 3/2009 O'Hagin et al.
7,497,774 B2 3/2009 Stevenson et al.
7,506,477 B2 3/2009 Flaherty et al.
7,507,151 B1 * 3/2009 Parker ..... F24F 7/025 454/341
7,509,775 B2 3/2009 Flaherty et al.
7,517,465 B2 4/2009 Guha et al.
7,531,740 B2 4/2009 Flaherty et al.
D593,193 S 5/2009 Jackson
D595,402 S 6/2009 Miyake
7,578,102 B2 8/2009 Banister
D601,237 S 9/2009 Nishio et al.
7,587,864 B2 9/2009 McCaskill et al.
7,618,310 B2 * 11/2009 Daniels ..... E04D 13/008 454/366
7,642,449 B2 1/2010 Korman et al.
D610,245 S 2/2010 Daniels
D612,040 S 3/2010 Daniels
7,678,990 B2 3/2010 McCaskill et al.
D618,780 S 6/2010 Williams, Sr.
7,736,940 B2 6/2010 Basol
7,757,440 B2 7/2010 Austin et al.
D625,800 S 10/2010 Daniels
7,901,278 B2 3/2011 O'Hagin
8,079,898 B1 12/2011 Stevenson
D654,161 S 2/2012 Holland et al.
8,167,216 B2 5/2012 Schultz et al.
8,292,707 B2 10/2012 Grisham et al.
8,316,592 B2 11/2012 Lanza
D685,112 S 6/2013 Henriquez
D685,113 S 6/2013 Henriquez
8,479,458 B2 7/2013 Morita et al.
8,535,128 B2 9/2013 Chwala
D696,392 S 12/2013 Funnell, II
8,607,510 B2 12/2013 Daniels
8,608,533 B2 12/2013 Daniels
D702,827 S 4/2014 Mase et al.
D703,305 S 4/2014 Stollenwerk O'Hagin
8,701,360 B2 4/2014 Ressler
8,740,678 B2 6/2014 Railkar et al.
8,776,455 B2 7/2014 Azoulay
8,782,967 B2 7/2014 Daniels
8,793,943 B2 8/2014 Daniels
D713,953 S 9/2014 Jepson
D719,253 S 12/2014 Francescon
9,011,221 B2 * 4/2015 Daniels ..... F24F 7/02 454/366
9,121,619 B2 * 9/2015 Potter ..... F24F 7/025
D748,239 S 1/2016 Daniels
D755,944 S 5/2016 Daniels
D766,413 S 9/2016 Zhou et al.
D768,276 S 10/2016 Kim et al.
D779,650 S 2/2017 Poehlman et al.
D788,281 S 5/2017 Daniels
D788,902 S 6/2017 Daniels
D796,661 S 9/2017 Oswald
D810,257 S 2/2018 Lai
2001/0027804 A1 10/2001 Inoue et al.
2001/0040201 A1 * 11/2001 Paxton ..... F04D 25/14 248/188.2
2002/0036010 A1 3/2002 Yamawaki et al.
2002/0104562 A1 8/2002 Emoto et al.
2003/0000158 A1 1/2003 Borges
2003/0159802 A1 8/2003 Steneby et al.
2004/0031219 A1 2/2004 Banister
2004/0098932 A1 5/2004 Broatch
2005/0074915 A1 4/2005 Tuttle et al.
2005/0127379 A1 6/2005 Nakata
2005/0130581 A1 6/2005 Dodge
2005/0144963 A1 7/2005 Peterson et al.
2005/0176270 A1 8/2005 Luch
2005/0178429 A1 8/2005 McCaskill et al.
2005/0191957 A1 * 9/2005 Demetry ..... F24F 7/025 454/341
2005/0233691 A1 10/2005 Horton
2005/0239393 A1 10/2005 Reese
2005/0239394 A1 * 10/2005 O'Hagin ..... E04D 1/30 454/366
2005/0263178 A1 12/2005 Montello et al.
2005/0263179 A1 12/2005 Gaudiana et al.
2005/0263180 A1 12/2005 Montello et al.
2005/0274408 A1 12/2005 Li et al.
2006/0017154 A1 1/2006 Eguchi et al.
2006/0032527 A1 2/2006 Stevens et al.

(56) References Cited

U.S. PATENT DOCUMENTS

2006/0052047 A1 3/2006 Daniels, II
2006/0052051 A1 3/2006 Daniels
2006/0086384 A1 4/2006 Nakata
2006/0124827 A1 6/2006 Janus et al.
2006/0199527 A1 9/2006 Peters
2006/0223437 A1 10/2006 O'Hagin
2007/0049190 A1 3/2007 Singh
2007/0066216 A1 3/2007 McIntire
2007/0067063 A1 3/2007 Ahmed
2007/0072541 A1 3/2007 Daniels et al.
2007/0084501 A1 4/2007 Kalberlah et al.
2007/0094953 A1 5/2007 Galeazzo et al.
2007/0173191 A1* 7/2007 Daniels, II ..... F24F 7/02 454/250
2007/0178827 A1 8/2007 Erni
2007/0184775 A1* 8/2007 Perkins ..... B60H 1/262 454/273
2007/0207725 A1* 9/2007 O'Hagin ..... E04D 13/008 454/365
2007/0243820 A1* 10/2007 O'Hagin ..... F24F 7/025 454/365
2007/0246095 A1 10/2007 Schaefer
2008/0040990 A1 2/2008 Vendig et al.
2008/0098672 A1* 5/2008 O'Hagin ..... E04D 1/30 52/173.3
2008/0163576 A1* 7/2008 Oaten ..... E04D 13/174 52/302.3
2008/0220714 A1 9/2008 Caruso et al.
2008/0287053 A1 11/2008 Carlson et al.
2008/0287054 A1 11/2008 Carlson et al.
2008/0299892 A1 12/2008 Robinson
2009/0203308 A1* 8/2009 O'Hagin ..... F24F 7/025 454/341
2009/0253368 A1 10/2009 Rotter
2009/0286463 A1* 11/2009 Daniels ..... F24F 7/02 454/366
2009/0311959 A1 12/2009 Shepherd
2010/0064605 A1 3/2010 Corvaglia et al.
2010/0068985 A1* 3/2010 Park ..... F24F 7/025 454/329
2010/0229940 A1 9/2010 Basol
2010/0287852 A1 11/2010 Bortoletto
2010/0300128 A1* 12/2010 Chen ..... F24F 7/025 62/125
2010/0330898 A1* 12/2010 Daniels ..... F24F 7/025 454/365
2011/0294412 A1 12/2011 Vagedes
2012/0110924 A1 5/2012 Makin
2012/0151856 A1 6/2012 Azoulay
2012/0178357 A1* 7/2012 Rheaume ..... F04B 17/006 454/343
2012/0190288 A1* 7/2012 Willen ..... E04D 1/30 454/250
2012/0252348 A1* 10/2012 Rheaume ..... F24F 7/025 454/343
2012/0322359 A1 12/2012 Chen et al.
2013/0019548 A1* 1/2013 Daniels ..... E04D 1/26 52/198
2013/0040553 A1* 2/2013 Potter ..... F24F 7/025 454/341
2013/0078903 A1 3/2013 Mantyla et al.
2013/0247480 A1 9/2013 Ridgway
2014/0065944 A1 3/2014 Chamness
2014/0099878 A1 4/2014 Daniels
2014/0248834 A1 9/2014 Kolt et al.
2015/0143760 A1 5/2015 Daniels
2015/0253021 A1 9/2015 Daniels

FOREIGN PATENT DOCUMENTS

| | | |
|---|---|---|
| GB | 2183819 | 6/1987 |
| GB | 2279453 | 1/1995 |
| GB | 2345536 | 7/2000 |
| JP | 59-060138 | 4/1984 |
| JP | H06 13304 U | 2/1994 |
| JP | 06-241517 | 8/1994 |
| JP | 06-272920 | 9/1994 |
| JP | 09-158428 | 6/1997 |
| JP | 10-061133 | 3/1998 |
| JP | 11-044035 | 2/1999 |
| JP | 11-229576 | 8/1999 |
| JP | 2000-274032 | 10/2000 |
| JP | 2002/357344 | 12/2002 |
| JP | 2004-092298 | 3/2004 |
| JP | 2007-534924 | 11/2007 |
| WO | WO 05/108708 | 11/2005 |
| WO | WO 2013/106882 | 7/2013 |

OTHER PUBLICATIONS

Roof Vents. (1/8-Designs-©Questel). orbit.com [online PDF] 27 pages. Uploaded 2014 [retrieved on Feb. 12, 2015]. Retrieved from I nternet: <http://sobjprd.questel.fr/exportIQPTUJ214/pdf2/5f7850ea-f617-4548-bc4 7 -08c3edb41 caO-222833.pdf>.

S-Type Vent. Formfomts.com[online] 1 page. Designed/built 2008 [retrieved on Feb. 12, 2015]. <http://www.formfonts.com/3D-Model/11 032/shell/b30-roofing/b301 0-roof-coverings/b3020-roof-openings/ohagins-concrete-tile-vent-type/>.

M-Type Vent. Formfomts.com[online] 1 page. Designed/built 2008 [retrieved on Feb. 12, 2015]. <https://www.formfonts.com/3D-Model/1 /11031/1 /shell/b30-roofing/b301 0-roof-coverings/b3020-roof-openings/ohagins-concrete-tile-vent-type-config/.

International Search Report for PCT/US2014/060964 dated Jan. 29, 2015.

European Extended Search Report in European Patent Application No. 14884739.5, dated Sep. 19, 2017.

* cited by examiner

ROOF VENT WITH AN INTEGRATED FAN

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

This application claims priority to U.S. Provisional Application Ser. Nos. 61/948,950, filed Mar. 6, 2014, and 62/043,988, filed Aug. 29, 2014, the disclosures of which are incorporated herein by reference in their entirety.

BACKGROUND

Field of the Invention

The present invention relates generally to roof ventilation systems for buildings, and specifically to integration of fans into roof vents.

Description of the Related Art

Ventilation of a building has numerous benefits for both the building and its occupants. For example, ventilation of an attic space can prevent the attic's temperature from rising to undesirable levels, which also reduces the cost of cooling the interior living space of the building. In addition, increased ventilation in an attic space tends to reduce the humidity within the attic, which can prolong the life of lumber used in the building's framing and elsewhere by diminishing the incidence of mold and dry-rot. Moreover, ventilation promotes a more healthful environment for residents of the building by encouraging the introduction of fresh, outside air. These and other benefits of ventilation tend to compound as ventilation increases. That is, the greater the flow rate of air that is vented through the building, the greater the benefits. Consequently, power devices such as fans have been employed in active ventilation systems to force greater air flow into and out of an attic space.

A consideration in roof ventilation is ease of installation. Some ventilation systems require a relatively lengthy and confusing installation procedure, which may involve the use of more than one kind of tradesperson. Such systems are more expensive to install and may suffer failures during operation due to faulty installation.

A problem with conventional roofs having fans (e.g., powered by solar panels) is that the fans may require replacement prior to the remainder of the roof, or prior to replacement of the vents through which the fans provide ventilation. Additionally, the installation or replacement of the fans may require retrofitting an existing, completed roofing installation, which can increase the likelihood of roof leaks at that location. Additionally, the maintenance or installation of the fans may be performed by another professional, such as an electrician, who lacks the expertise to safely walk on a roof, or work on roofing components, such as roof vents or roofing elements. Weather proofing elements (e.g., mastic, peel and stick membranes, tar, adhesives and other flashing and roofing materials can be damaged by such disturbances under some conditions. Accordingly, a ventilation system that improves on one or more of these concerns and that is relatively easy to install and replace is desirable.

SUMMARY

For purposes of summarizing the invention and the advantages achieved over the prior art, certain objects and advantages of the invention have been described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

In a first aspect, a roof vent member is disclosed. The roof vent member comprises a subflashing, an upper plate and a fan assembly. The subflashing comprises a subflashing body and a subflashing opening extending through the subflashing body. The upper plate comprises an upper plate body and an upper plate opening extending through the upper plate body. The fan assembly is operably coupleable to the subflashing and upper plate such that the subflashing is interposed between the upper plate and the fan assembly, with the fan assembly configured to be removed and replaced from under a roof deck when the subflashing is mounted on an upper surface of the roof deck. For example, the fan assembly can be configured to be removed and replaced from under a roof deck when the subflashing is weatherproofed into an upper surface of the roof deck.

In another aspect, a roof vent member is disclosed that comprises an upper plate having a plurality of fasteners. The upper plate comprises an upper plate body having a lower surface, a first opening extending through the upper plate body, and the plurality of fasteners positioned around the first opening and projecting generally downward from the lower surface. The roof vent member further comprises a subflashing comprising a subflashing body, a second opening extending through the subflashing body, and a first plurality of access holes extending through the subflashing body around the second opening. The roof vent member further comprises a fan assembly comprising a fan, fan housing, and a motor, wherein a second plurality of access holes extend through the fan housing. The upper plate, the subflashing, and the fan assembly are configured to allow the fasteners to extend through the first and second pluralities of access holes, to couple the upper plate and the fan assembly with the subflashing, with the subflashing positioned between the upper plate and the fan assembly, and to allow at least a portion of the fan assembly to extend below a lower surface of a roof deck when the subflashing is mounted on an upper surface of the roof deck.

In some embodiments, the roof vent member optionally includes the plurality of fasteners where the fasteners each comprise a threaded distal end opposed from the lower surface of the upper plate body.

In some embodiments, the roof vent member includes the subflashing optionally having a lip coupled with and projecting generally upward from the subflashing body, where the lip forms a perimeter around the second opening and is positioned between the second opening and the first plurality of access holes. The lip may be configured to be received by the first opening of the upper plate.

In some embodiments, a roof comprising the roof vent member is disclosed, where the roof comprises the roof deck having a roof deck opening, and the subflashing is coupled with the upper surface of the roof deck around the roof deck opening to allow ventilation through the roof deck opening. In some embodiments, a first portion of the fan assembly is laterally surrounded by the roof deck, and a second portion of the fan assembly extends below a lower surface of the roof deck.

In another aspect, a roof vent is disclosed. The roof vent comprises the roof vent member and a secondary vent member. The secondary vent member is configured to be positioned above the roof vent member.

In some embodiments, the roof vent optionally includes a solar panel. The solar panel may optionally be secured to an upper surface of the secondary vent member. In some embodiments, the solar panel is flexible.

In some embodiments, the roof vent has the secondary vent member configured such that the roof vent is one of an S-shaped roof vent and an M-shaped roof vent, and the solar panel extends between at least two curved apexes formed on an upper surface of the secondary vent member.

In another aspect, a method for removing a fan assembly from a roof deck is disclosed. The roof deck may have one or more roof vent members mounted to an upper surface of the roof deck to allow fluid communication through a roof deck opening extending through the roof deck, with each roof vent member comprising an upper plate, a subflashing and a fan assembly, and the subflashing positioned between and coupled with the upper plate and fan assembly. The method comprises removing the fan assembly from the remainder of the roof vent member from a position below the roof deck without decoupling the remainder of the roof vent member from the roof deck. Removing the fan assembly comprises decoupling the fan assembly from the upper plate and lowering the fan assembly in a first direction away from the upper plate.

In another aspect, a method for installing a roof vent member is disclosed. The roof vent member may comprise a fan assembly and the roof vent member may be installed to an upper surface of the roof deck to allow fluid communication through a roof deck opening extending through the roof deck. In some embodiments, the roof vent member comprises an upper plate, a subflashing and a fan assembly, with the subflashing positioned between and coupled with the upper plate and fan assembly. The method may comprise moving the roof vent member from above the roof deck towards the roof deck opening in a first direction such that at least a portion of the fan assembly extends through the roof deck opening and below a lower surface of the roof deck, and mounting the subflashing on an upper surface of the roof deck. Moving the roof vent member and mounting the subflashing may be performed from a position above the roof deck. Removing the fan assembly may further comprise removing at least one sealing element positioned between at least one of the subflashing and the fan assembly, and the fan assembly and the lower plate.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION

Figure 2:
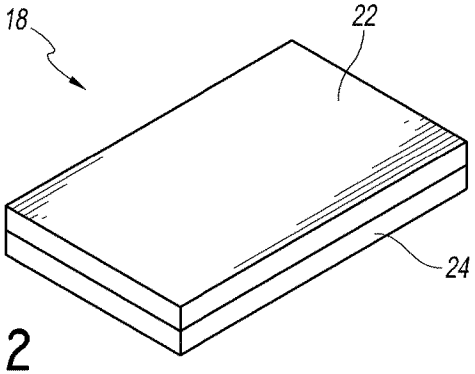
FIG. 2 is a perspective view of a flat tile with a solar panel attached thereto.

Various embodiments of roof vents with an integrated fan assembly and associated methods are disclosed. The roof vents may include a primary (e.g., lower) roof vent member having the integrated fan assembly and a secondary (e.g., upper) roof vent member. The primary roof vent member includes features for accessing the fan assembly and for performing various operations related to the fan assembly from underneath a roof. For instance, the fan assembly can be installed, removed, replaced, repaired, etc. from underneath the roof. This allows for performing these and other operations in an easy and simple manner without needing to get on the roof or disturbing the weather-proofing of the vent installation and/or other elements of the roof. For example, these operations on the fan assembly can be performed within an interior attic space, or other space below the roof. Embodiments also provide less invasive access to the fan assembly to perform such operations. For instance, the roof deck envelope need not be altered in order to access the fan assembly, saving time and money associated with removal, repair and/or remodeling of portions of the roof and associated systems, such as an electrical system. Thus, unlike conventional roof fans, removal and/or replacement of the fan assembly can be performed without having to remove tiles, shingles, portions of the vent, or other building structures, or otherwise having to disturb the building envelope.

Some of the features which allow for these and other advantages of the disclosed roof vent include an upper plate with downwardly projecting fasteners with which the fan assembly couples. The upper plate can be installed with a subflashing on a roof deck either prior to or after coupling it with the fan assembly. The fan assembly can be easily installed with the fasteners of the upper plate by raising the fan assembly towards the fasteners, for example, from underneath the roof deck. Similarly, the fan assembly can be easily removed, replaced, etc. by lowering the fan assembly away from the fasteners, for example, from underneath the roof deck. The fasteners may be received by access holes that extend through the fan assembly, and the fan assembly may be secured with the upper plate using complementary fastening elements that couple with the ends of the fasteners that protrude downward beyond the fan assembly. Other roof vent elements may be installed, removed, replaced, etc. in a similar manner, including but not limited to a lower plate, one or more sealing elements, and/or one or more screens, each of which may have access holes that receive the fasteners and are coupled thereon by coupling the complementary fastening elements with the ends of the fasteners that protrude downward beyond the lowest component of the roof vent, for instance the lower plate. Thus, one or more of the upper plate, subflashing, lower plate, sealing elements, and/or screens can be secured to the fan assembly in a stacked configuration to be mounted onto a roof. Each of these components has one or more openings extending therethrough. When these components are stacked together, these openings collectively form a channel through the roof vent, which in turn provides ventilation through the roof when the roof vent is installed over (e.g., into) a corresponding opening in a roof deck. The roof vent may include a variety of different types of secondary roof vent members, including but not limited to flat, tapered composition, S-shaped, and M-shaped, each of which may have a variety of types of solar panels attached thereto. These and other features of the disclosed roof vent and associated methods will now be discussed in further detail with reference to the figures.

FIGS. 1-11 provide context for various roofing structures with which embodiments of the roof vent with an integrated fan assembly described herein can be combined or implemented.

Figure 1:
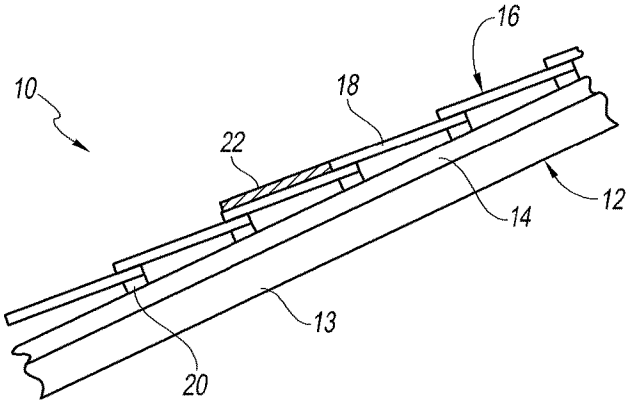
FIG. 1 is a cross-sectional side view of a portion of a tile roof with a solar panel secured to one of the tiles.

FIG. 1 is a cross-sectional side view of a portion of an exemplary tile roof 10 comprising a roof frame 12, a roof deck 14 supported on the roof frame 12, and a layer 16 of roof cover elements. In this embodiment, the roof cover element layer 16 comprises a layer of tiles 18. However, the roof cover elements may alternatively comprise other elements, such as shingles (e.g., made of steel, metal, composition material, wood, or other materials). The tiles 18 may be formed of, e.g., metal, clay, concrete, plastic, or other materials. The roof frame 12 may comprise rafters 13 that extend from an upper ridge (not shown) of the roof to a lower eave (not shown). The roof frame 12 may also comprise purlins (not shown) that extend substantially parallel to the ridge and eave and substantially perpendicular to the rafters 13. The roof deck 14 typically comprises plywood, metal, or some type of alloy (e.g., steel) sheeting. The roof cover element layer 16 typically comprises a plurality of tiles 18 supported on battens 20 oriented substantially parallel to the ridge and eave (and substantially perpendicular to the rafters 13). In the illustrated roof 10, each batten 20 directly supports an upper edge of a tile 18, which in turn supports a lower edge of an immediately adjacent tile 18. In this arrangement, water tends to flow over each tile's lower edge onto another tile 18. The illustrated tiles 18 are flat tiles, as known in the art. Alternative tile shapes are also possible, including so-called "S-shaped" or "M-shaped" tiles, which are described below, and many other tile shapes.

The illustrated roof 10 can include a solar panel 22 secured to one of the tiles 18. The solar panel 22 can be flexible and configured to substantially conform to a flat or curved surface of one or more of the tiles 18. The roof 10 can include any number of solar panels 22. The solar panels 22 can be used to power a variety of different types of devices, such as ventilation fans, motorized vent doors, and the like. The solar panels 22 can alternatively or additionally be used simply to collect power (in the form of solar energy) that can be stored in a battery for later use. In some municipalities, the solar panels 22 can even deliver energy into the community's electrical grid, often in exchange for reduced electrical bills.

As mentioned, the roof tiles 18 can comprise flat tiles, S-shaped tiles, M-shaped tiles, or other shapes. As used herein, the terms "flat tile," "S-shaped tile," and "M-shaped tile" are to be construed as having their understood meanings within the roofing industry.

FIG. 2 is a perspective view of a roof tile 18 having a generally flat tile body 24 and a solar panel 22. The solar panel 22 is secured to and can substantially conform to a flat surface of the tile body 24. In some embodiments, the solar panel 22 may be a flat solar panel. The solar panel 22 may also be a flexible solar panel that conforms to the flat tile body 24.

Figure 3:
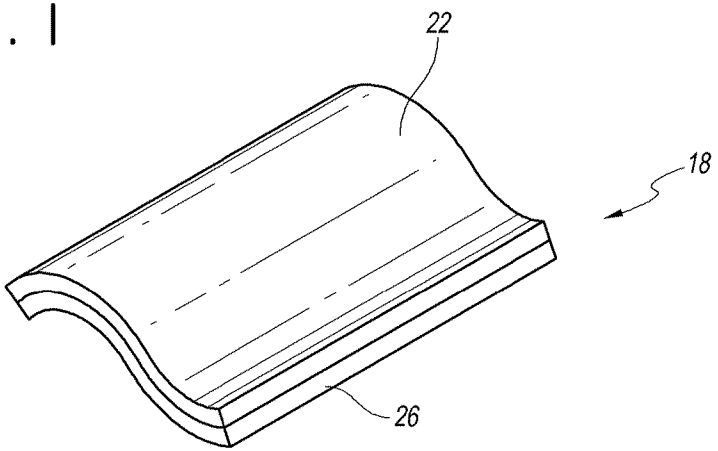
FIG. 3 is a perspective view of an S-shaped tile with a solar panel attached thereto.

FIG. 3 is a perspective view of an S-shaped roof tile 18 having a generally curved tile body 26 and a solar panel 22. The solar panel 22 is secured to and can substantially conform to a curved surface of the tile body 26. In some embodiments, the solar panel 22 may be flexible, for example, to allow it to conform to the curved surface of the tile body 26 as shown.

Figure 4:
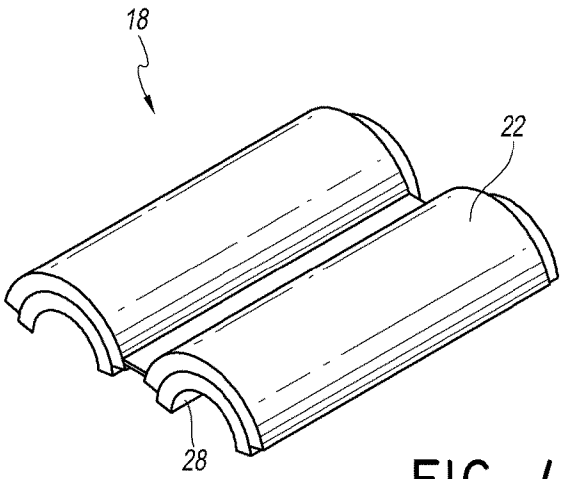
FIG. 4 is a perspective view of an M-shaped tile with a solar panel attached thereto.

FIG. 4 is a perspective view of an M-shaped roof tile 18 having one or more generally curved tile bodies 28 and a solar panel 22. The solar panel 22 is secured to and can substantially conform to a curved surface of the tile body 28. In some embodiments, the solar panel 22 may be flexible, for example, to allow it to conform to the curved surface of the tile body 28. Skilled artisans will appreciate that the solar panel 22 can be secured to and conform with a variety of different shapes of roof cover elements (including, without limitation, tiles and/or shingles). It will be understood that the roof cover elements may be formed of a variety of materials, such as, without limitation, wood shingles, composition shingles, metal shingles, steel shingles, metal (e.g., sheet metal) tiles, clay tiles, concrete tiles, plastic tiles, or other materials.

In one embodiment, the solar panel 22 comprises a durable, lightweight, spectrum-splitting amorphous silicon cell design on a flexible stainless steel sheet. Vinyl and foam modules can be encapsulated in UV stabilized polymers and bonded and stitched to a cushioned backing material. Suitable solar panels 22 are sold by United Solar Systems Corp. of Troy, Mich., under the trademark UNI-SOLAR. These are merely examples of a variety of suitable solar panels may be implemented.

Figure 5:
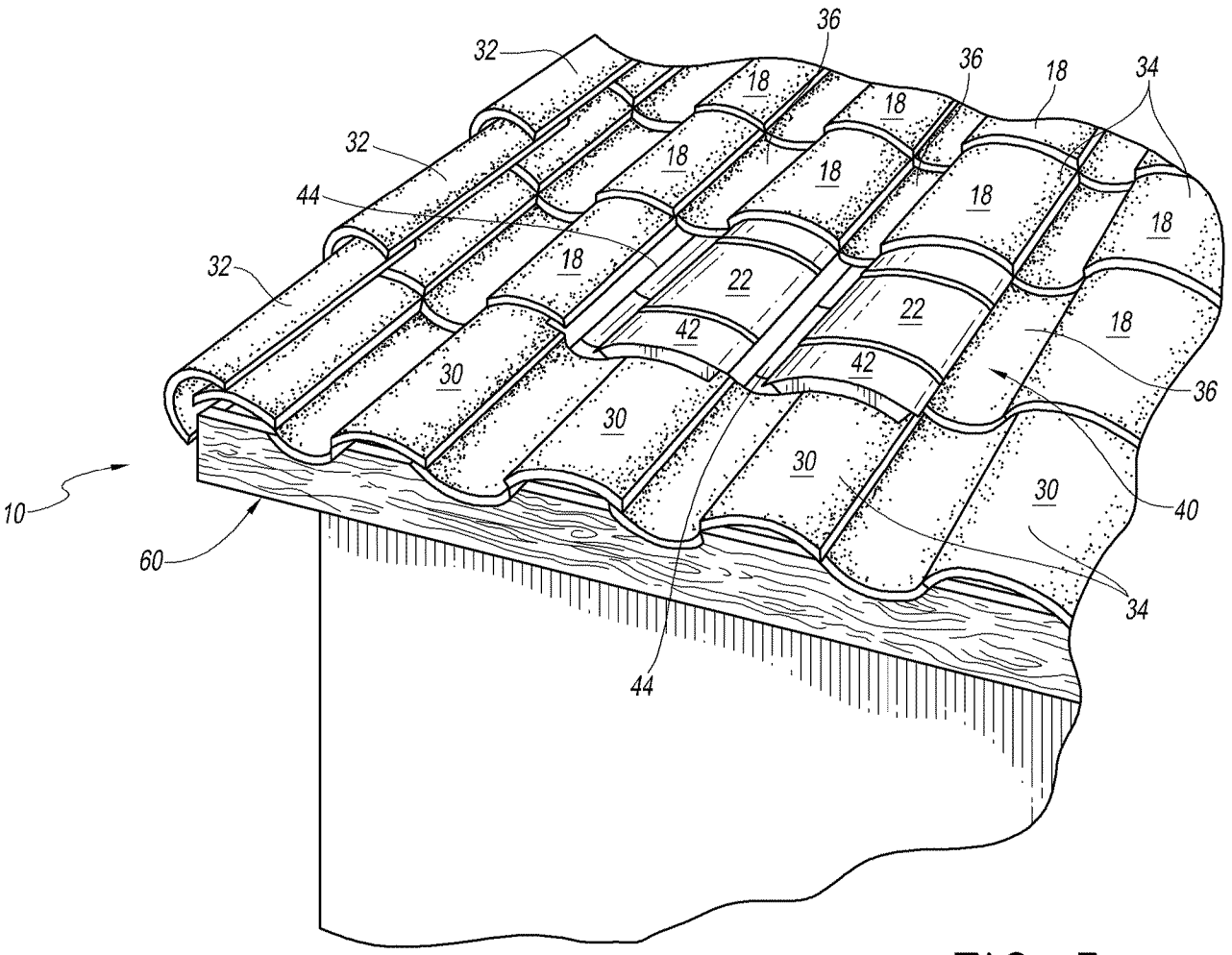
FIG. 5 is a perspective view of portion of a tile roof comprising S-shaped tiles and having an S-shaped roof vent with solar panels attached thereto.

FIG. 5 is a perspective view of a section of a pitched tile roof 10 near an eave 60 and comprising S-shaped tiles 18 with an S-shaped roof vent 40 and solar panels 22, in accordance with one embodiment. The roof 10 comprises S-shaped roof tiles 18. A row of edge tiles 30 are provided at the eave 60, and a column of edge caps 32 are provided on the side edges of the roof 10. Ridge caps (not shown) can be provided at the ridge (not shown). In this particular configuration, the tiles 18 and 30 each include a cap area 34 and a pan area 36. The cap areas 34 and pan areas 36 of vertically aligned tiles 18, 30 form cap columns and pan channels, respectively, such that the roof comprises alternating parallel cap columns and pan channels. Further details of the configuration of the roof 10 of FIG. 5 are shown and described in U.S. Pat. No. 6,050,039, the disclosure of which is hereby incorporated by reference in its entirety.

The illustrated roof 10 of FIG. 5 includes a roof vent 40 preferably adapted to blend into the roof 10 and mimic the appearance of one or more of the roof tiles 18. In one embodiment, the roof vent 40 is preferably substantially as shown and described in U.S. Pat. No. 6,050,039. The vent 40 preferably includes one or more cap sections 42 and corresponding pan sections 44. As such, each cap section 42 and corresponding pan section 44 preferably mimics the appearance of one cap section 34 and pan section 36, respectively. In the illustrated embodiment, the roof vent 40 mimics the appearance of two roof tiles 18. However, skilled artisans will appreciate that the vent 40 can mimic the appearance of any desired number of roof tiles 18, including just one roof tile 18. In this document, roof cover elements (e.g., roof tiles) and roof vents (e.g., tile vents) may be collectively referred to as "roof members."

Figure 6:
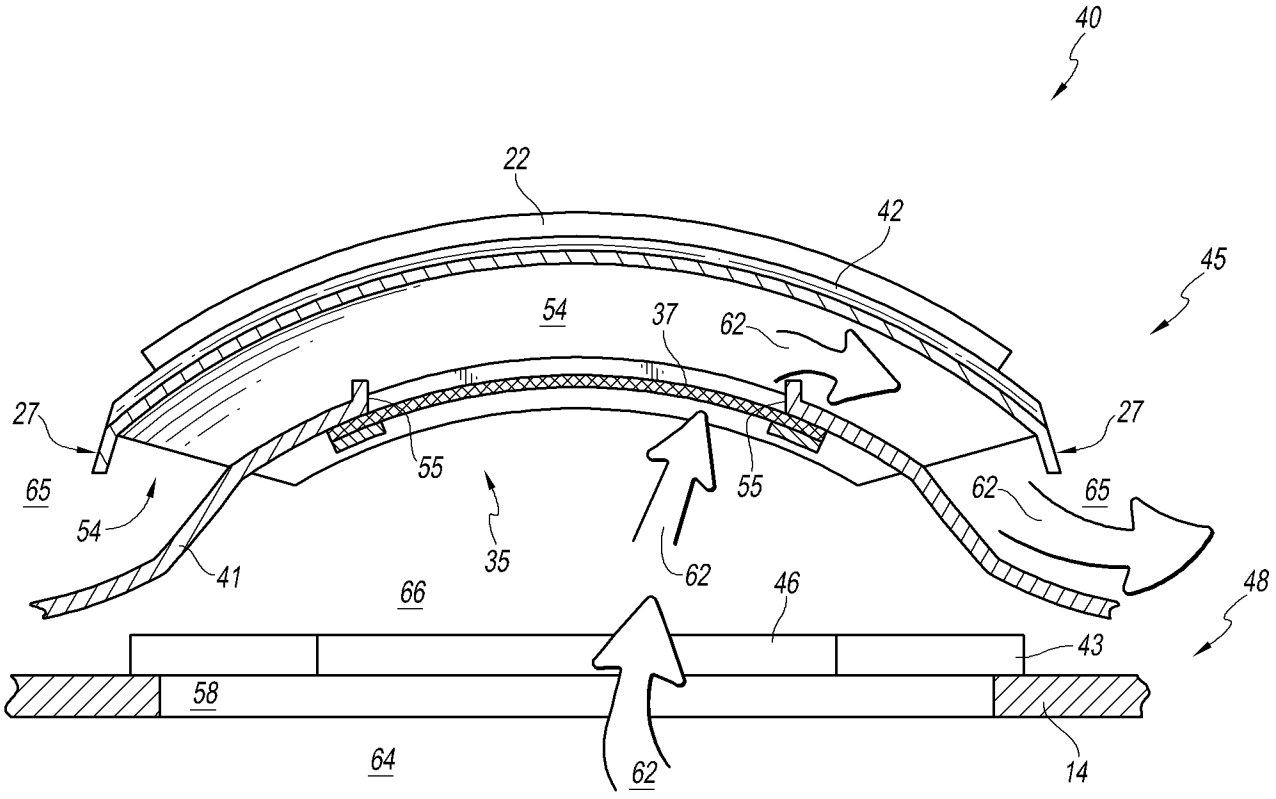
FIG. 6 is a cross-sectional view of a portion of the S-shaped roof vent of FIG. 5.

Solar panels 22 can be affixed on the upper curved surfaces of the cap sections 42. The solar panels 22 can be form-fitting and conform to the curved upper surfaces of the cap sections 42. Preferably, the solar panels 22 are adhered to the cap sections 42. However, skilled artisans will appreciate that there are other ways to affix the solar panels 22 to the roof vent 40. While only shown affixed to the cap sections 42 of the roof vent 40, the solar panels 22 can alternatively or additionally be affixed to and be in conformity with the curved upper surfaces of the pan sections 44. Also, while two separate solar panels 22 are shown attached to the two cap sections 42, in some configurations it is possible to use a different number of solar panels, including just one solar panel for each vent 40. In some embodiments, a solar panel can extend between and/or across two or more vents, or two or more sections within a single vent. Preferably, electrical connections are provided for transferring solar energy absorbed by the solar panels 22 to a battery, municipal power grid, or other electrical devices. It will be appreciated that the roof 10 can include any suitable number of roof vents 40 with solar panels 22. In a preferred embodiment, roof vents are generally arranged near the ridge and eaves of the roof FIG. 6 is a cross-sectional view of a portion of the roof vent 40 from FIG. 5 with the solar panel 22 attached thereto. The roof vent 40 is preferably substantially as shown and described in U.S. Pat. No. 6,050,039. As illustrated in FIG. 6, the roof vent 40 comprises a roof vent member 48, a secondary vent member 45 spaced above the roof vent member 48, and a solar panel 22 secured to an upper curved surface of a cap member 42 of the secondary vent member 45. The roof vent member 48 includes a subflashing 43. The subflashing 43 is secured to the roof deck 14, over a roof deck opening 58 thereof. The roof deck opening 58, which may be an aperture or other passageway through the roof deck 14, provides fluid communication between the attic 64 of the building and a space 66 (such as a batten cavity) above the roof deck 14. The roof vent member 48 includes an opening 46, which may be an opening in the subflashing 43 and which may be screened, that fluidly communicates with the roof deck opening 58.

The secondary vent member 45 is spaced generally above the vent member 48. In one embodiment, the secondary vent member 45 is secured to the vent member 48 for example to the subflashing 43 by spacer elements (not shown). In this embodiment, the secondary vent member 45 can also be secured to adjacent surrounding tiles, such as to an upper or lower tile 18, 30 (e.g., with a storm clip). While such an embodiment ensures a desired physical relationship between the vent member 48 and the secondary vent member 45, it can also be problematic when the surrounding tiles (e.g., 18, 30, 32) are positioned inaccurately with respect to the secondary vent member 45. In general, a high degree of skill is required in the installation of the various tiles and roof vent(s) for accurate positioning thereof. In an alternative embodiment, the secondary vent member 45 is secured to one or more adjacent tiles in the roof's field of tiles, without being secured to the vent member 48. For example, the secondary vent member 45 can be secured (e.g., by a storm clip) to a lower and/or upper adjacent tile of a pitched roof (i.e., a tile in an adjacent upper or lower row). This embodiment allows for greater flexibility in the positioning of the tiles relative to the vent member 48.

The illustrated secondary vent member 45 includes a "skeleton" 41 with a vent opening 35 generally above the vent opening 46. The vent opening 35 may be covered by a screen 37. Elongated upstanding baffles 55 can be provided to help prevent wind-driven rain from flowing down through the vent opening 35. The cap member 42 is preferably secured to the skeleton 41 so that a ventilation space 54 is formed therebetween, for example by using any of a wide variety of different types of spacer elements. The cap member 42 is preferably positioned above the vent opening 35 to substantially prevent the ingress of rain through the vent opening 35. Elongated side hems or downward baffles 27 can be provided to help prevent wind-driven rain from flowing down through the vent opening 37. In use, attic air 62 flows from the attic 64 through the roof deck opening 58, vent opening 46, space or batten cavity 66, vent opening 35, and ventilation space 54 to the outside 65.

FIG. 6 shows a single cap section 42 above the opening 46 of the vent member 48. Thus, FIG. 6 is a simplification of the roof vent 40 of FIG. 5, which includes two cap sections 42 and two pan sections 44. Skilled artisans will understand that the roof vent 40 can have any number of cap sections and pan sections, and that all of such sections may be provided generally above one opening 46 of the vent member 48. Also, the secondary vent member 45 can replace any number of tiles in a field of tiles, including just one such tile.

Figure 7:
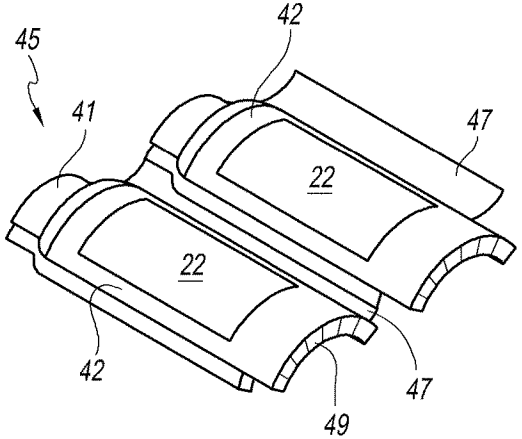
FIG. 7 is a perspective view of the secondary vent member and cap members of the S-shaped roof vent of FIG. 5.

FIG. 7 is a perspective view of the secondary vent member 45 of the roof vent 40 of FIGS. 5 and 6. In this embodiment, the skeleton 41 comprises two S-shaped portions, each of which has one attached cap member 42. The forward edges of the cap members 42 can have downwardly depending flanges 49, to help prevent the ingress of rain or snow through the vent 40. Two solar panels 22 are provided, each being secured with a curved upper surface of one of the cap members 42. There are two pan sections 47, which are configured to align with the aforementioned pan areas 36 of the roof tiles 18, 30 (FIG. 5). Similarly, the cap members 42 are configured to align with the cap areas 34 of the roof tiles 18, 30. Thus, the roof vent 40 advantageously mimics the appearance of and substantially blends in with the roof tiles 18, 30 of the pitched tile roof 10. The solar panels 22 may have a different color than that of the tiles 18 and secondary vent member 45. For example, the solar panels 22 may be generally black. In some embodiments, by conforming to the shape of the cap members 42, the solar panels 22 do not substantially affect or alter the profile of the roof vent 40.

Figure 8:
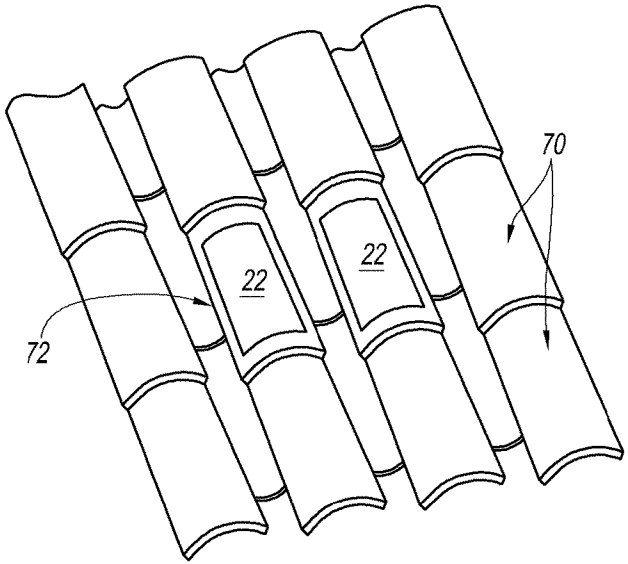
FIG. 8 is a perspective view of a portion of a tile roof comprising M-shaped tiles and having an M-shaped roof vent with solar panels attached thereto.

FIG. 8 is a perspective view of a portion of a tile roof comprising M-shaped tiles 70 and having an M-shaped roof vent 72 with solar panels 22 attached thereto. In an embodiment, the M-shaped roof vent 72 is constructed substantially similarly to the above-described S-shaped roof vent 40 of FIGS. 5-7, the difference being that the vent 72 is sized, configured, and shaped to resemble one or more of the M-shaped tiles 70. The solar panels 22 can each be secured in conformity with a curved upper surface of the vent 72.

Figure 9:
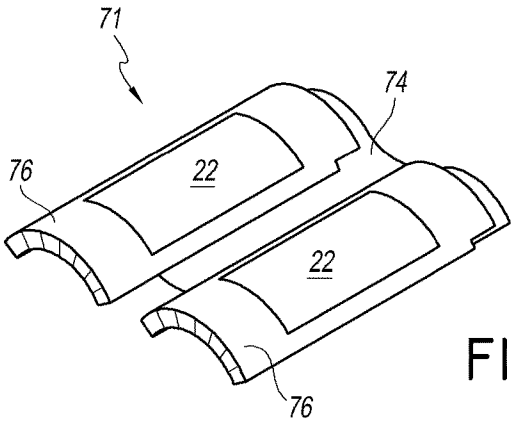
FIG. 9 is a perspective view of a secondary vent member and cap members of the M-shaped roof vent of FIG. 8.

FIG. 9 is a perspective view of a secondary vent member 71 of the M-shaped roof vent 72 of FIG. 8. In the illustrated embodiment, the solar panels 22 are secured in conformity with curved upper surfaces of cap members 76 secured to cap sections of a skeleton 74.

Figure 10:
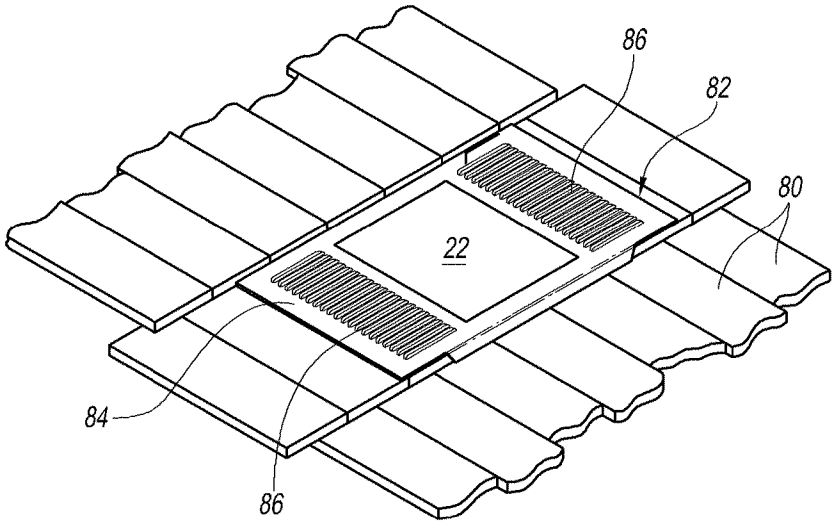
FIG. 10 is a perspective view of a tile roof comprising flat tiles and having a flat roof vent with a solar panel attached thereto.
Figure 11:
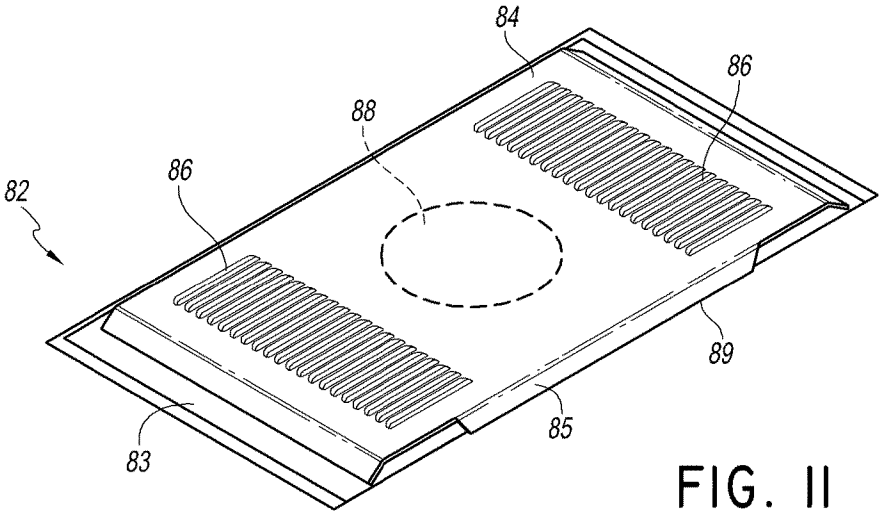
FIG. 11 is a perspective view of the flat roof vent of FIG. 10 without the solar panel.

While the aforementioned solar panels 22 have been illustrated and described in the context of being attached to roof vents having curved surfaces, skilled artisans will understand that they can also be attached to flat surfaces of roof cover elements. FIGS. 10 and 11 illustrate the use of the solar panels 22 on a substantially flat roof vent. FIG. 10 is a perspective view of a portion of a tile roof comprising flat tiles 80 and having a substantially flat roof vent 82 with a solar panel 22 attached thereto. The flat roof vent 82 can replace one or more of the flat tiles 80.

FIG. 11 is a perspective view of the roof vent 82 of FIG. 10 with the solar panel 22 removed. A variety of different types of flat roof vents can be employed. For example, the roof vent 82 may be substantially as shown and described in U.S. Pat. No. 6,129,628, the disclosure of which is hereby incorporated by reference in its entirety. Accordingly, the roof vent 82 can comprise a lower substantially flat base 83 and a substantially flat cover member 84. The base 83 has an opening 88 in fluid communication with an aperture (not shown) in the roof deck. Preferably, the cover member has one or more openings 86, such as slits or louvers as shown. The cover member 84 is preferably opaque, such that the base opening 88 would not be visible in the view of FIG. 11. However, to better illustrate the vent 82, FIG. 11 shows the base opening 88 and not the solar panel 22. In use, attic air travels through the roof deck aperture, the base opening 88, and through the openings 86. In addition or alternatively, the air can also travel through the roof deck aperture, the base opening 88, and through a front opening 89 between the base 83 and a front edge or flange 85 of the cover member 84. The vent 82 is preferably configured to blend in with and mimic the appearance of the flat tiles 80.

While described and illustrated in the context of tile roofs, the solar panels 22 can be applied to a variety of different types of roof coverings, including shingles and composition sheeting.

Figure 12A:
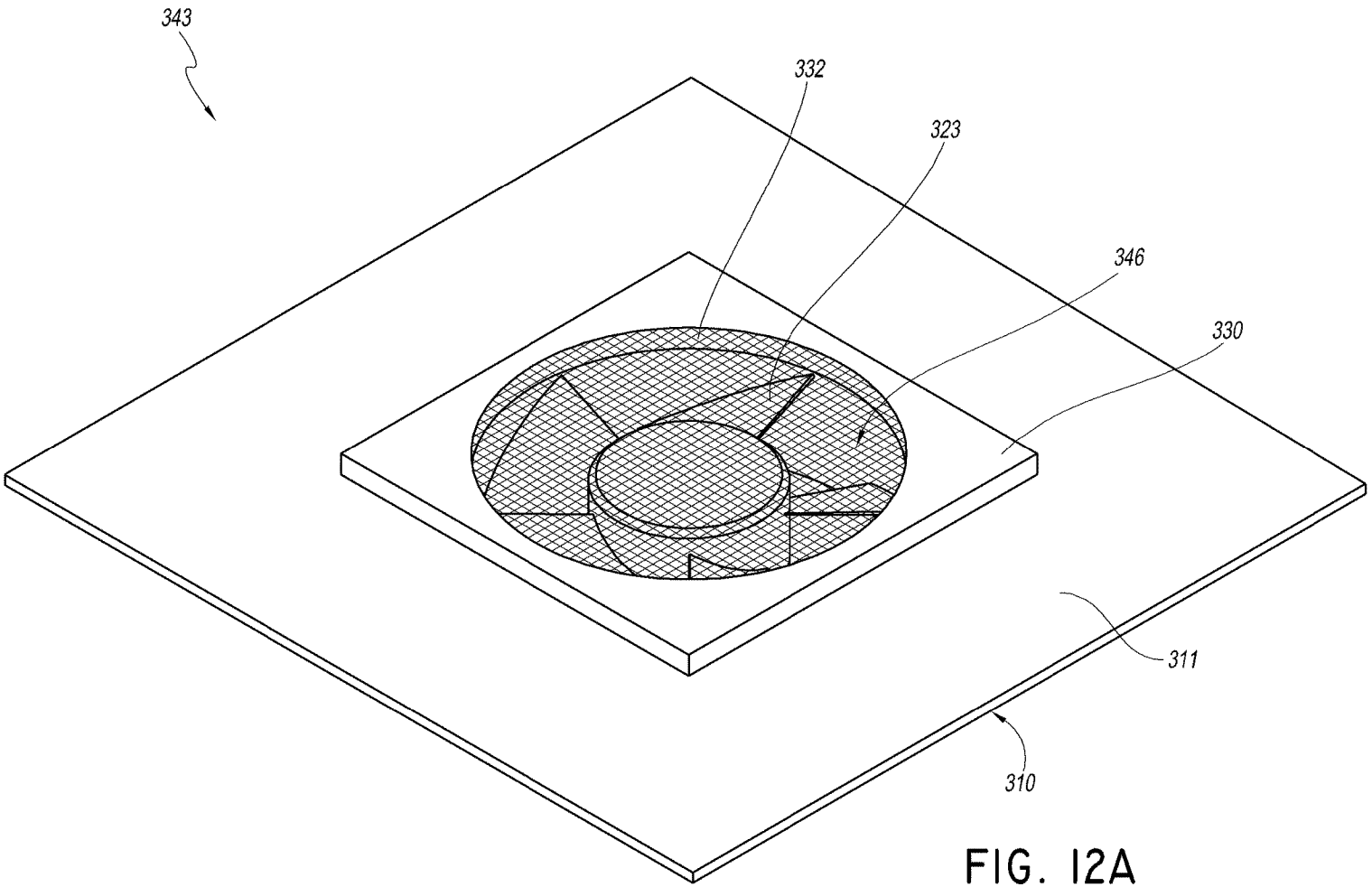
FIG. 12A is a top perspective view of an embodiment of a roof vent member.
Figure 12B:
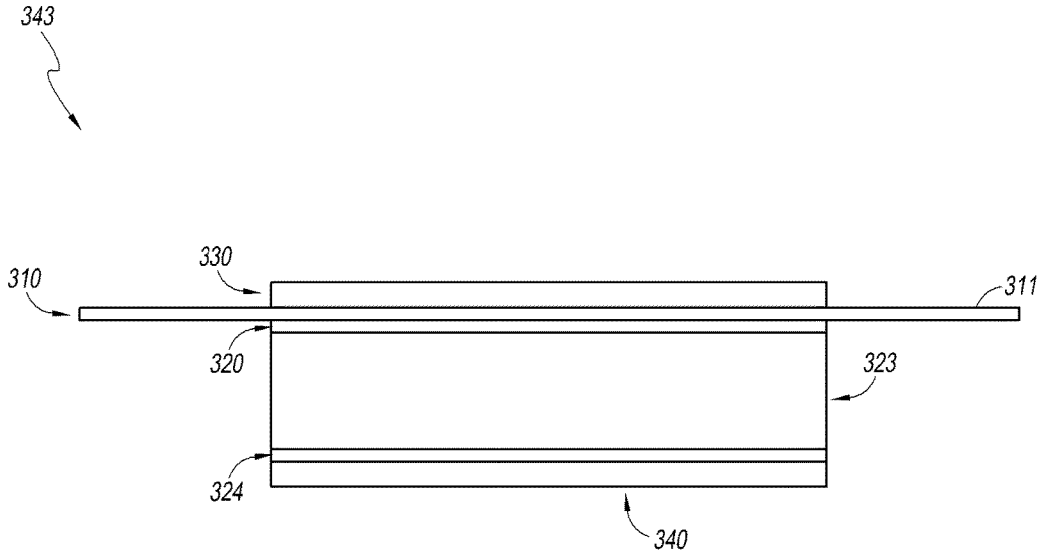
FIG. 12B is a side view of the roof vent member of FIG. 12A.
Figure 12C:
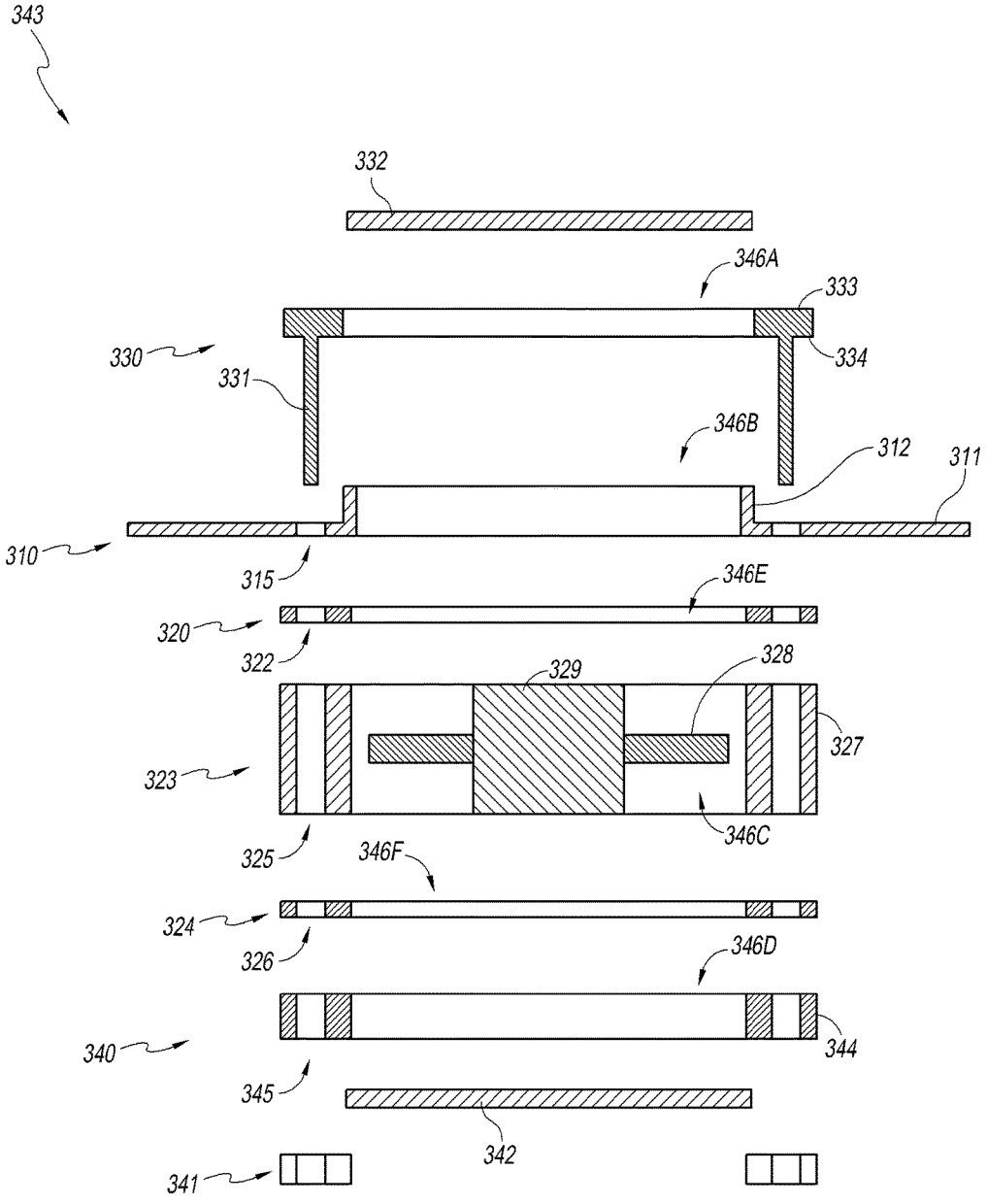
FIG. 12C is a side cross-sectional exploded view of the roof vent member of FIG. 12A.
Figure 12D:
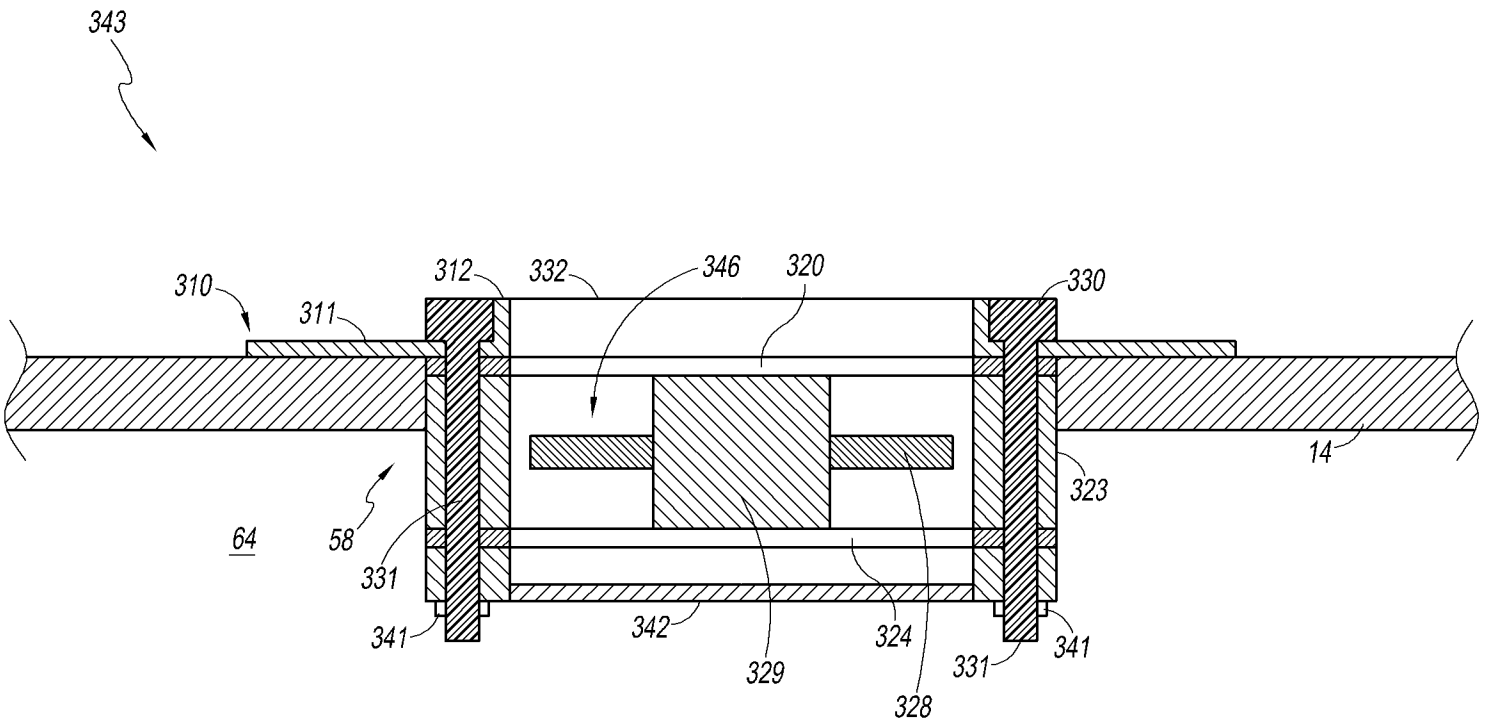
FIG. 12D is a side cross-sectional view of the roof vent member of FIG. 12A installed with a roof deck.

FIG. 12A is a top perspective view of an embodiment of a roof vent member 343, which may also be termed a "primary vent member," e.g. when implemented in combination with a secondary vent member, as described elsewhere herein. FIG. 12B is a side view of the roof vent member 343. FIG. 12C is a side cross-sectional exploded view of the roof vent member 343 installed with a roof deck. FIG. 12D is a side cross-sectional view of the roof vent member 343 installed with a roof deck.

Referring to FIGS. 12A-12D, the roof vent member 343 can be similar to the other primary or roof vent members described herein, and can be similarly employed with the other various vents and components described herein. For example, the roof vent member 343 can replace vent member 48 of the S-shaped roof vent 40 in FIG. 6 to allow ventilation through the roof deck opening 58 of the roof deck 14. The roof vent member 343 can include a channel 346 (FIGS. 12A and 12D) formed from one or more openings extending through its various components, to allow airflow through the corresponding roof deck aperture.

The roof vent member 343 can include a subflashing 310 configured to be installed on the surface of a roof deck. The subflashing 310 can include a body 311 that may have side members, such as flanges, extending out from an opening 346B extending through the subflashing body 311. The subflashing 310 may be coupled with the upper surface of the roof deck 14 around the roof deck opening, to allow ventilation through the roof deck opening. The subflashing 310 can include a lip 312 (shown in FIG. 12C) extending upwardly from and around the opening 346B, to prevent debris and/or water from flowing down the roof deck and into the opening 346B. The lip 312 may be coupled with and project generally upward from the subflashing body 311. The lip 312 may form a perimeter around the opening 346B and may be positioned between the opening 346B and one or more access holes 315. The lip 312 may be configured to be received by openings in other components of the vent member 343, such as the opening 346A of the upper plate 330. The lip 312 can be received by opening 346A, to improve the engagement (e.g., sealing) between the upper plate 330 and the subflashing 310. The access holes 315 may be smaller openings extending through the subflashing body 311 that allow the subflashing 310 to be coupled with other components, such as other components of the vent member 343. The access holes 315 may be any shape suitable to receive one or more fasteners 331 from the upper plate 330. For example, the access holes described herein can comprise an open or closed shape, such as an open slot or enclosed channel, respectively, or other shape, that can receive a fastener to allow coupling between two adjacent components.

The roof vent member 343 can include an integrated fan assembly 323. The fan assembly 323 can include a fan housing 327, which can contain a fan 328 having one or more fan blades driven by a motor 329. The fan assembly 323 is configured to engage with one or more parts of the roof vent member 343, such as a lower surface of the subflashing 310. In some embodiments, a first upper portion of the fan assembly 323 is laterally surrounded by the roof deck 14, and a second lower portion of the fan assembly 323 extends below the lower surface of the roof deck 14. The fan assembly 323 is configured to generate airflow through an opening 346C of the fan, through the remainder of the vent member 343, and through the opening 58 of the roof deck 14 (FIG. 12D). Referring to FIGS. 6 and 12A-12D, the fan assembly 323 can be positioned in a region (for example, the attic 64) below the roof adjacent the vent opening 35 of the secondary vent member 45. The fan assembly 323 can be positioned below, but offset to, a secondary vent member 45, as described further below with respect to FIG. 15D. The fan assembly 323 can be aligned with the secondary vent opening 35 to efficiently generate airflow through the vent opening 35. A skilled artisan will appreciate that the position and configuration of the fan assembly 323 may be varied depending on the design of the ventilation system.

The fan housing 327 may include one or more access holes 325. The access holes 325 may be formed or otherwise defined by, and extend through, the fan housing 327. In some embodiments, the access holes 325 are formed by and in the structure of the fan housing 327 and extend from an upper surface of the housing 327 to a lower surface thereof. The access holes 325 may be arranged around or near an outer perimeter of the fan housing 327. The access holes 325 may extend around the opening 346C. The holes 325 may have a similar shape and/or locations as other holes of the vent member 343, such as the holes 315 of the subflashing 310, such that the various holes of the various components align when the vent member 343 is configured for installation with the roof deck 14. The holes 325 may have a variety of shapes, including circular or other shapes. In some embodiments, the holes 325 have a shape that complements the shape of the fasteners 331 of the upper plate 330, discussed below, such that lateral play of the fasteners 331 inside the holes 325 is reduced or removed. In some embodiments, the holes 325 are shaped and/or sized to provide an interference fit with the fasteners 331.

The fan assembly 323 can be attached to or otherwise coupled with the subflashing 310 or other parts of the roof vent member 343 in various ways. The fan can be powered by a solar panel, battery, or other power supply, and or can include a control system and other electronic features, as described in U.S. Pat. No. 8,608,533, issued on Dec. 17, 2013, the entire contents of which are herein incorporated by reference. The roof vent member 343 can include an upper plate 330 configured to couple the fan assembly 323 with the subflashing 310. The upper plate 330 can be configured to provide increased support to the fan assembly 323 relative to the support provided by the subflashing alone without the upper plate 330. For example, the upper plate 330 can comprise a stronger material, a different dimension (e.g., an increased thickness), and/or a more rigid shape than the subflashing 310, to provide increased support to the fan assembly 323 when the subflashing 310 and upper plate 330 are coupled thereto. Such support can be important due to the vibrations over time caused by the fan operation, which can loosen the components of the vent member 343, causing roof leakage or vent failure. The roof vent member 343 can include a lower plate 340 to provide additional support between the fan assembly 323 and other components of vent member 343. The upper and lower plates 330, 340 can include openings 346A and 346D, respectively, to allow ventilating air flow therethrough. Thus, two or more of openings 346A-346D, which can be similar or different shapes with respect to each other, can collectively form the channel 346 through vent member 343, when two or more of the upper plate 330, fan assembly 323, lower plate 340, and subflashing 310, and/or other vent components, are stacked together.

The upper plate 330 can include an upper plate body 333 and one or more fasteners 331. Fasteners 331 can be configured to engage with complementary fastening elements 341, to couple the subflashing 310 to the fan assembly 323. The fasteners 331 may engage with the complementary fastening elements 341 when the fasteners 331 are extended into, or in some embodiments, completely through corresponding access holes of other components of the vent member 343, such as access holes 345, 325, and 315 in the lower plate 340, the housing 327 of the fan assembly 323, and the subflashing 310, respectively. The fasteners 331 can be configured to allow the fan assembly 323 to be removed from a position below the roof deck 14. Such lower removal of the fan assembly can allow it to be replaced from, for instance, an attic space, and without needing to walk on the roof and risk damaging the roof cover elements or otherwise disturbing the building envelope. Additionally, the roof vent member 343 with the integrated fan assembly 323 can be installed by a roof professional, for example, during the initial roof installation, without disturbing the roofing envelope, or making other modifications (other than the hole in the roof deck), and without requiring a professional from another trade, such as an electrician.

The upper plate body 333 may be a generally flat, planar structure configured to couple with the subflashing 310 and/or other components of the roof vent member 343. The upper plate body 333 may be formed from a variety of materials, such as metal or other suitable materials. In some embodiments, the upper plate body 333 is a rigid material configured to support the weight of various components, such as the fan assembly 323. The upper plate body 333 can be configured to provide greater strength in supporting the fan assembly 323 than the subflashing 310. For example, the upper plate body can comprise a material with a greater rigidity, thickness, and/or yield strength, than that of the subflashing. The subflashing may comprise a thinner, more flexible, and/or weaker material than the upper plate 333, to allow the subflashing to better conform to and/or seal with a roof deck. The upper plate body 333 may have a variety of shapes, i.e. plan forms, as viewed from the top or bottom. In some embodiments, the upper plate body 333 has a generally polygonal plan form, but it may also have a more rounded shape, and/or combinations thereof. For instance, the upper plate body 333 may have a plan form that is square, rectangular, circular, hexagonal, a shape with partially straight and partially rounded sides, etc.

The upper plate body 333 can include an opening 346A. The opening 346A can extend through the upper plate body 333. In some embodiments, the opening 346A is defined by one or more edges or surfaces of the upper plate body 333. For instance, the opening 346A may be formed or otherwise defined by a continuous inner edge at or near the center of the upper plate body 333. The opening 346A may have a variety of shapes. In some embodiments, the opening 346A is circular. It may also be any other shape, such as elliptical, oval, square, rectangular, other straight-sided shapes, or combinations thereof. The opening 346A may match the shape of the other openings in the roof vent member 343, such as the openings 346B, 346C, 346D of the subflashing 310, the fan housing 327, and the lower plate 340, respectively.

The upper plate body 333 can include a lower surface 334. The lower surface 334 may be one or more surfaces of the upper plate body 333 that is on the underside of the body 333. In some embodiments, the lower surface 334 is a surface on the underside of the upper plate body 333 and extends from an outer edge of the upper plate body 333 to an inner edge. The lower surface 334 may be interrupted or otherwise intersected by various features of the upper plate 330. In some embodiments, the lower surface 334 includes the underside of the upper plate body 334, extends from an outer edge of the underside to an inner edge of the opening 346A, and is interrupted by one or more fasteners 331. Thus, the lower surface 334 may include various areas or portions of the underside of the upper plate body 334 located around these or other features of the upper plate body 334. In some embodiments, the lower surface 334 is coupled with various features of the upper plate 330, such as the fasteners 331.

As mentioned, the upper plate body 333 can include one or more fasteners 331. The fasteners 331 can be any structural components with features configured for coupling the upper plate 330, subflashing 310, and fan assembly 323, to each other, or to additional components. The fasteners 331 can comprise an elongated member, such as a rod, screw, pin, or other similar structure. The fasteners 331 can have a circular, square, or other cross-sectional shape. The fasteners can be configured to couple to additional components, such as the complementary fastening elements 341. The fasteners 331 can be located on the lower surface 333 of the upper plate 330 and project in a generally downward direction when the roof vent member 343 is installed with the roof. The fasteners 331 can be located on the lower surface 333 in various positions around the opening 346A of the upper plate 330. In some embodiments, the fasteners 331 can be located along a perimeter (e.g., generally circular) or other shaped arrangement around the opening 346A. The fasteners 331 may be located near or adjacent to the opening 346A, or in other locations. In some embodiments, the fasteners 331 can comprise cylindrical projections extending downward from the upper plate 330. The fasteners 331 can have engaging features, such as external or internal threads thereon or therein, to engage with another corresponding structure, such as an internal or external threaded structure, respectively. The threads or other engaging features may extend along some, most, or substantially the entire length of the fasteners 331, or they may only be on portions thereof. For instance, the fasteners 331 may have threads only near the tips or distal ends of the fasteners 331, with an intervening unthreaded portion between the distal end and the lower surface 334 of the upper plate body 333. The "distal end" is the end of the fasteners 331 opposed from the lower surface 334 of the upper plate body 333. As discussed in further detail below, in some embodiments, the fasteners 331 may have a bore or other blind hole or passageway that opens at the distal end. For instance, the fasteners 331 may have an internally-threaded hole on the distal ends of the fasteners 331 into which complementary fastening elements 341, for example externally-threaded bolts, may engage.

The fasteners 331 may be coupled with the upper plate body 333 in a variety of ways. In some embodiments, the fasteners 331 are of a unitary construction with respect to the upper plate body 333. For instance, the fasteners 331 and the upper plate body 333 may be machined, cast, molded, or otherwise formed from the same piece of raw material. As another example, the fasteners 331 and the upper plate body 333 may be welded or otherwise permanently secured together. Thus, the fasteners 331 and the upper plate body 333 may form a single, monolithic structure. In some embodiments, the fasteners 331 may be separate components attached to or otherwise coupled with the upper plate body 333. For example, the fasteners 331 may be attached to the lower surface 334 with brackets or other attachments. The coupling may be direct or indirect. For instance, the fasteners 331 may be directly attached to the lower surface 334 or there may be an intermediate attachment structure between the fasteners 331 and the upper plate body 333. In some embodiments, the fasteners 331 may be coupled with the upper plate body 33 by mechanical or other means. For instance, the fasteners 331 may be bonded or otherwise adhered to or with the upper plate body 333. In some embodiments, combinations of these or other coupling means may be implemented to couple the fasteners 331 with the upper plate body 333.

The upper plate 330, the subflashing 310, and the fan assembly 323 are configured to allow the fasteners 331 to extend through the holes 315 of the subflashing 310 and through the holes 325 of the fan housing 327. For instance, the upper plate 330, the subflashing 310, and the fan assembly 323 may be aligned such that their respective holes align and provide a passageway for the fasteners 331. This allows the upper plate 330 and the fan assembly 323 to couple with the subflashing 310. The subflashing 310 can be positioned between the upper plate 330 and the fan assembly 323 with at least a portion of the fan assembly 323 extending below a bottom surface of the roof deck 14 when the subflashing 310 is mounted on an upper surface of the roof deck 14. The fasteners 331, by extending downward from the upper plate 330 and into the space under the roof deck 14, allow the fan assembly 323 to be accessed from under the roof deck 14. This allows for easy installation and/or removal of the fan housing 323 from inside the house or other building structure. Thus, the upper plate 330, the subflashing 310, and the fan assembly 323 are configured to allow the fan assembly 323 to be removed and replaced from under the roof deck 14 when the subflashing 310 is mounted on the upper surface of the roof deck 14.

The engagements shown and described herein, either above or below, between the various components of the roof vent member 343 are for illustrative purposes, and it will be understood that other engagement means for attaching these components are possible. For example, the subflashing 310 may be attached to the upper plate 330 using attachment means that are separate from those that attach the fan assembly 323 to the subflashing 310, e.g. to allow removal of the fan assembly 323 without disengaging the upper plate 330 from the subflashing 310.

As mentioned, the roof vent member 343 can include a lower plate 340. The lower plate 340 and upper plate 330 can comprise similar or different shapes and/or materials with respect to each other. The lower plate 340 can include a lower plate body 344. The lower plate body 344 may be a generally flat, planar structure configured to couple with the fan assembly 323, such as the fan housing 327, and/or other components of the roof vent member 343. The lower plate body 344 may be formed from a variety of materials, such as metal or other suitable materials. In some embodiments, the lower plate body 344 can comprise a rigid material configured to support the weight of various components, such as the fan assembly 323. The lower plate body 344 may have a variety of shapes, i.e. plan forms, as viewed from the top or bottom. In some embodiments, the lower plate body 344 has a generally polygonal plan form, but it may also have a more rounded shape, and/or combinations thereof. For instance, the lower plate body 344 may have a plan form that is square, rectangular, circular, hexagonal, a shape with partially straight and partially rounded sides, etc. The lower plate body 344 may have a shape that matches or otherwise complements the shape of the fan housing 327.

The lower plate body 344 can include an opening 346D. The opening 346D can extend through the lower plate body 344. In some embodiments, the opening 346D is defined by one or more edges or surfaces of the lower plate body 344. For instance, the opening 346D may be formed or otherwise defined by a continuous inner edge at or near the center of the lower plate body 344. The opening 346D may have a variety of shapes. In some embodiments, the opening 346D is circular. It may also be any other shape, such as elliptical, oval, square, rectangular, other straight-sided shapes, or combinations thereof. The opening 346D may match the shape of the other openings in the roof vent member 343, such as the openings 346A, 346B, 346C of the upper plate 330, the subflashing 310, and the fan housing 327, respectively.

The opening 346D, and/or the openings 346A, 346B and 346C, may be configured to form ventilation channel 346 (FIGS. 12A; 12D) when the components of the member 343 are stacked together, and, for example, when the openings are aligned together. The ventilation channel can have a substantially non-frustoconical shape, to increase the uniformity of the air flow velocity through vent member 343. The ventilation channel may also have an approximately uniform cross-sectional size, shape, or both, along its length. In some embodiments, the openings 346A, 346B, 346C, and/or 346D may be configured to form a ventilation channel that has a generally uniform shape along its length, such as a generally cylindrical shape. Other shapes for the ventilation channel may be implemented as well.

The lower plate body 344 can include upper and lower surfaces configured to couple with various features of the roof vent member 343. The lower surface may be one or more surfaces of the lower plate body 344 that are on an underside of the body 344. In some embodiments, complementary fastening elements 341 attach to portions of the fasteners 331 that extend through access holes 345 and which butt up against the lower surface of the lower plate body 344. The access holes 345 may be formed or otherwise defined by, and extend through, the lower plate body 344. In some embodiments, the access holes 345 are formed by and in the structure of the lower plate body 344 and extend from the upper surface of the lower plate body 344 to the lower surface thereof. The access holes 345 may be arranged around or near an outer perimeter of the lower plate body 344. The holes 345 may have a similar shape and/or locations as other holes of the vent member 343, such as the holes 315 of the subflashing 310 and fan housing 327, such that the various holes of the various components align when the vent member 343 is configured for installation with the roof deck 14. The holes 345 may have a variety of shapes, including circular or other shapes. In some embodiments, the holes 345 have a shape that complements the shape of the fasteners 331 of the upper plate 330, such that lateral play of the fasteners 331 inside the holes 345 is reduced or removed. In some embodiments, the holes 345 are shaped and/or sized to provide an interference fit with the fasteners 331. The lower plate 340, the upper plate 330, the subflashing 310, and the fan assembly 327 are configured to allow the fasteners 331 to extend through the access holes 345, to couple the lower plate 340 with the subflashing 310, with the lower plate 340 positioned under the fan assembly 323.

As mentioned, the complementary fastening elements 341 may couple with the fasteners 331. In some embodiments, the complementary fastening elements 341 are configured to removeably attach to portions of the fasteners 331 extending downward beyond the various components of the roof vent member 343. In some embodiments, the complementary fastening elements 341 are configured to removeably attach to portions of the fasteners 331 extending downward beyond the fan assembly 323 to couple the upper plate 330, the subflashing 310 and the fan housing 327. In some embodiments, the complementary fastening elements 341 are configured to removeably attach to portions of the fasteners 331 extending downward beyond the lower plate 340 to couple the upper plate 330, the subflashing 310, the fan housing 327 and the lower plate 340. The complementary fastening elements 341 may engage with the distal ends of the fasteners 331, as defined above.

In some embodiments, the fastening elements 341 can be configured to removably attach to portions of the fasteners 331 that extend into, but not completely through or beyond another component of vent member 343. For example, the fastening elements 341 can be recessed below an upper surface of another component of vent member 343, such as the lower plate 340, to allow the fasteners 331 to extend into the upper surface and engage with the fastening elements 341, without extending the fasteners through the lower plate 340. In some embodiments, the various components of the vent member 343 may include recesses around their respective access holes that receive the complementary fastening elements 341. For instance, the fan housing 327 or the lower plate 340 may include recesses around the access holes 325 or 345, respectively, into which complementary fastening elements, such as nuts or bolts, extend when tightened to couple the vent member 343 components together. The fastening elements 341 can be configured to allow a snap fit, and/or interference fit, between the fastening elements 341 and fasteners 331.

The complementary fastening elements 341 may be nuts or other structures with internal threads that mate with corresponding external threads of the fasteners 331. Fastening elements 341 can be an insert that is positioned within an opening extending into or through one or more components of member 343, such as within access holes 325 or 345. Fastening elements 341 can have an outer perimeter (e.g., diameter) that is greater than a corresponding outer perimeter (e.g., diameter) of any access holes on a corresponding part of vent member 343. The elements 341 may be tightened onto the fasteners 331 to compress together the various components of the roof vent member 343, such as the upper plate 330, the subflashing 310, the fan housing 327 and the lower plate 340. The elements 341 may be of various types, such as locking, nonlocking, crimped, etc. The elements 341 may be of formed from various materials, such as steel, titanium, aluminum, other materials besides metal, or combinations thereof. The complementary fastening elements 341 may be a variety of other fastening elements besides nuts, such as clamps, brackets, etc.

In some embodiments, the fasteners 331 provide internal coupling features and the complementary fastening elements 341 include complementary external coupling features. For instance, the fasteners 331 may be elongated projections that include an internally threaded bore into which the complementary fastening elements 341 are screwed. In some embodiments, the fasteners 331 have internal threads with which external threads of the complementary fastening elements 341 attach by rotating the elements 341 into the fasteners 331. Further, the fasteners 331 may include combinations of internal and/or external coupling features. For instance, some of the fasteners 331 may be externally-coupling fasteners while others may be internally-coupling. Similarly, the complementary fastening elements 341 may include combinations of internal and/or external coupling features, such as internally threaded nuts and externally threaded bolts.

These are just some of the various configurations that may be implemented with the fasteners 331 and the complementary fastening elements 341 that allow for access to the fan assembly 323 from under the roof. By attaching the complementary fastening elements 341 to or otherwise with the portions of the fasteners 331 extending through an underside of the roof vent member 343, such as with the distal ends of the fasteners 331, the elements 341 may be removed from under the roof, and thus the fan assembly 323 or portions thereof may also be easily removed from under the roof by sliding the assembly 323 down and away from the fasteners 331. To reinstall or replace the fan assembly 323, for instance with a second or replacement fan assembly 323, the second fan assembly 323 can slide over the fasteners 331, with the fasteners extending through the holes 325 in the fan housing 327, and the complementary fastening elements 341 can then be secured to the distal tips or portions of the fasteners 331 extending downward beyond the fan assembly 323. If the roof vent member 343 includes the lower plate 340 or other components, they can be removed and/or installed in a similar fashion.

The roof vent member 343 can further include screens 332, 342 to cover and prevent damage to fan assembly 323, and/or prevent injury caused by fan assembly 323, through openings 346A and 346D, respectively, of upper and lower plates 330, 340, respectively. The screens 332, 342 can be separate components that are separately attached to the plates 330, 340, or they can be integrally formed components thereof, or combinations of separate and integral. It will be understand that either or both screens 332, 342, or additional screens, can be employed with roof vent member 343.

The roof vent member 343 can further include one or more sealing elements. In some embodiments, the roof vent member 343 can include one or both of an upper sealing element 320 and/or a lower sealing element 324. The sealing element 320 can be configured to be positioned and form a seal between the subflashing 310 and the fan assembly 323. The sealing element 324 can be configured to be positioned between and form a seal between the fan assembly 323 and the lower plate 340. The sealing elements 320, 324 can include openings 346E, 346F, respectively, that can further form the ventilation channel 346 when configured with the other components of the roof vent member 343. The sealing elements 320, 324 can also include access holes 322, 326, respectively, that allow the sealing elements 320, 324 to be coupled with the other components. In some embodiments, the upper sealing element 320 can be positioned in between the subflashing 310 and the fan assembly 323, with the opening 346E aligned with the openings 346B and 346C, respectively, and the access holes 322 aligned with the access holes 315 and 325, respectively. In some embodiments, the lower sealing element 324 is positioned in between the fan assembly 323 and the lower plate 340, with the opening 346F aligned with the openings 346C and 346D, respectively, and the access holes 322 aligned with the access holes 325 and 345, respectively. Another sealing element (not shown) can be positioned and form a seal between the subflashing 310 and the upper plate 330. The sealing elements described herein can comprise a rubber, plastic, or other material suitable for sealing the aforementioned vent member components. The sealing elements can reduce the likelihood of leakage between components of the vent member 343 and from channel 346. Such leakage can overwork, and thus cause premature failure of fan assembly 323, and/or increase the number of vent members 343 needed to provide a certain amount of ventilation within a roof structure.

While described above with some reference to S-shaped roof vents, such as that shown in FIG. 6, it will be understood that a vent member with an integrated fan, such as vent member 343, can be applied to other types of vents, such as vents designed to be used with M-shaped, flat, composition, shingle, or other types of roofs. Additionally, the advantages described above (e.g., allowing access to the fan for maintenance or replacement from underneath the roof, such as in an attic) that reduce the need to walk on the roof and risk disturbing the roof envelope or damaging the roof to replace or maintain a fan, can be implemented with many vent types, such as S-shaped, M-shaped, flat, composition, or other vents. Examples of roofing technologies with which the present application can be implemented are disclosed in, for example, U.S. Pat. Nos. 8,608,533, 8,607,510, 7,618,310, U.S. Pat. App. Pub. No. 2010/0330898, and U.S. Pat. No. 7,101,279, the entire contents of each which are hereby incorporated by reference herein.

Figure 13A:
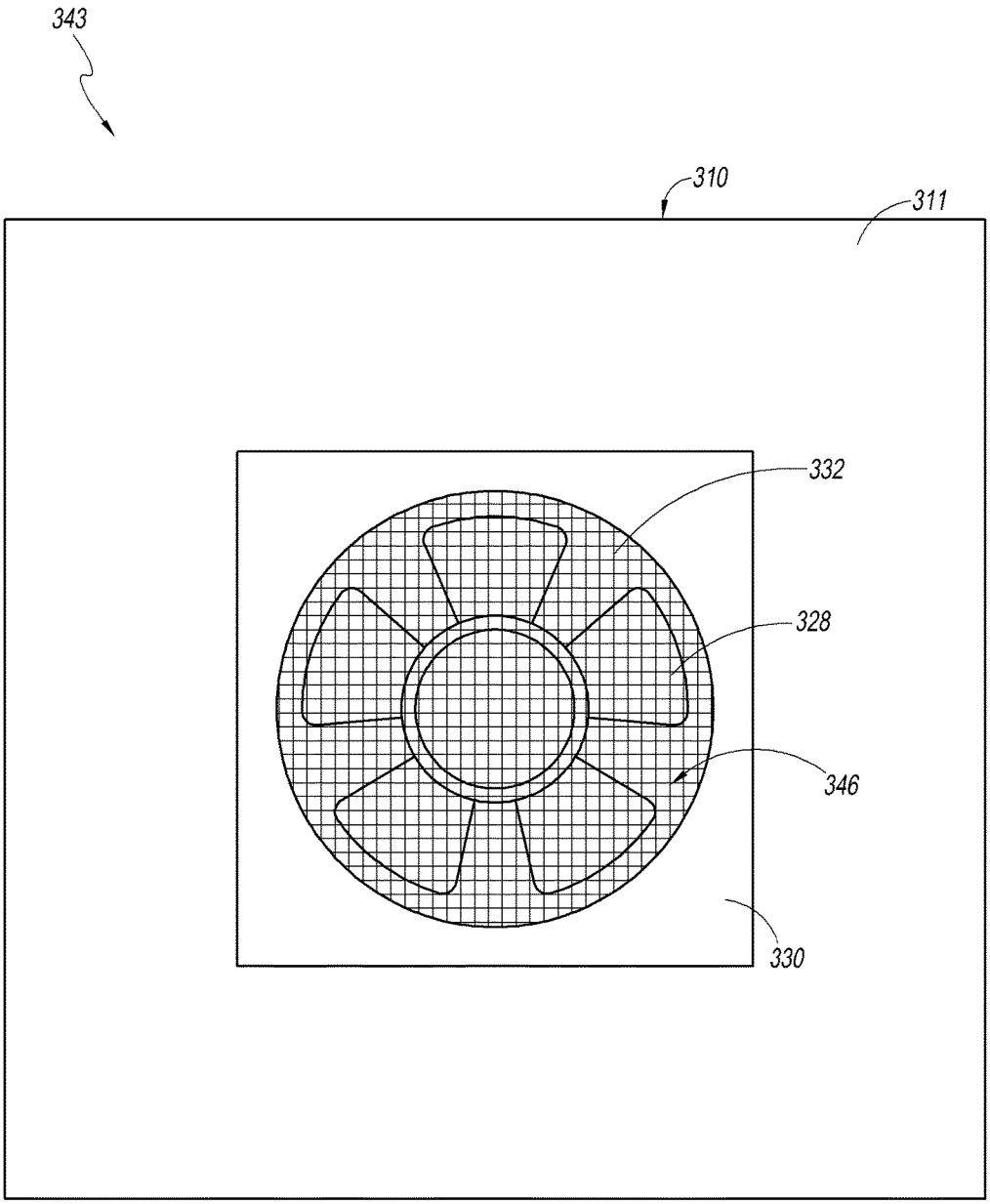
FIG. 13A is a top view of the roof vent member of FIG. 12A.
Figure 13B:
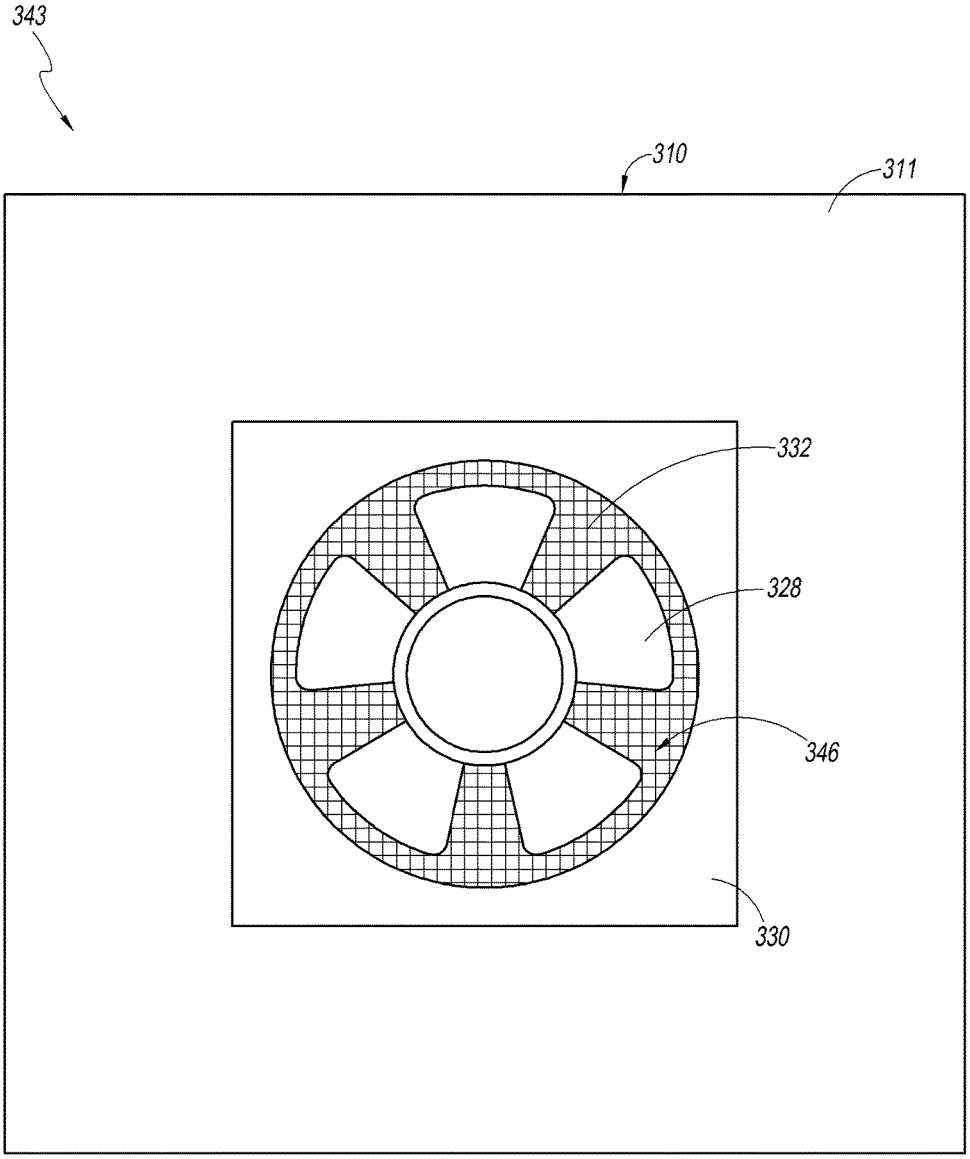
FIG. 13B is a top view of the roof vent member of FIG. 12A without an upper screen.

FIGS. 13A and 13B are top views of the roof vent member 343. FIG. 13A shows the member 343 with the upper screen 332 attached thereto. FIG. 13B shows the same member 343 but without the upper screen 332 such that the lower screen 342 is shown coupled on an underside of the roof vent member 343. As shown in FIGS. 13A and 13B, the subflashing 310 and the upper plate 330 each have a generally square or rectangular plan form shape and the vent opening 346 has a generally circular cross-section shape. As mentioned, these are merely examples and other shapes, orientations and/or configurations may be implemented. For example, the roof vent members herein can be implemented without any screens.

Figure 14A:
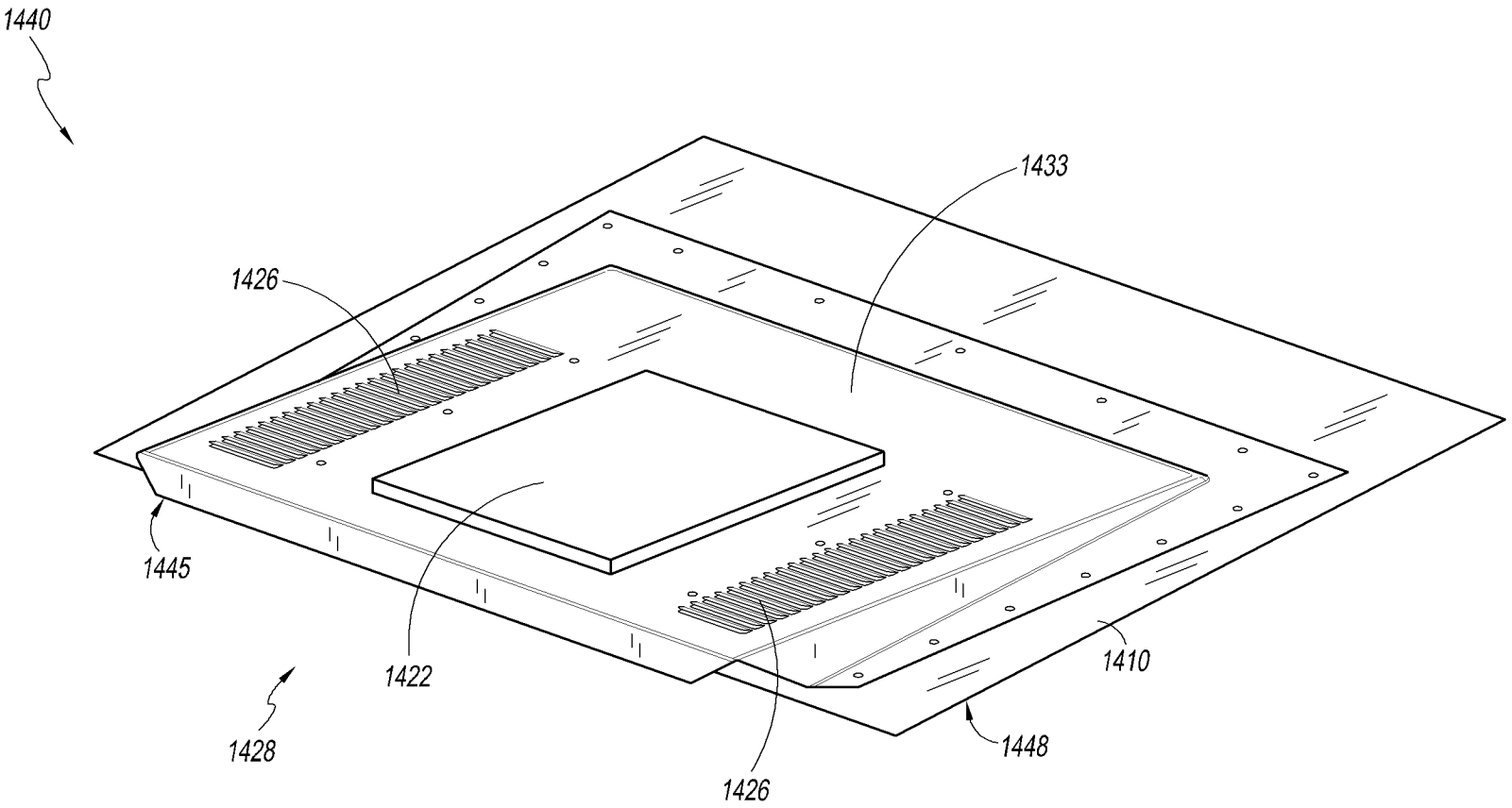
FIG. 14A is a top perspective view of an embodiment of a tapered composition roof vent.
Figure 14B:
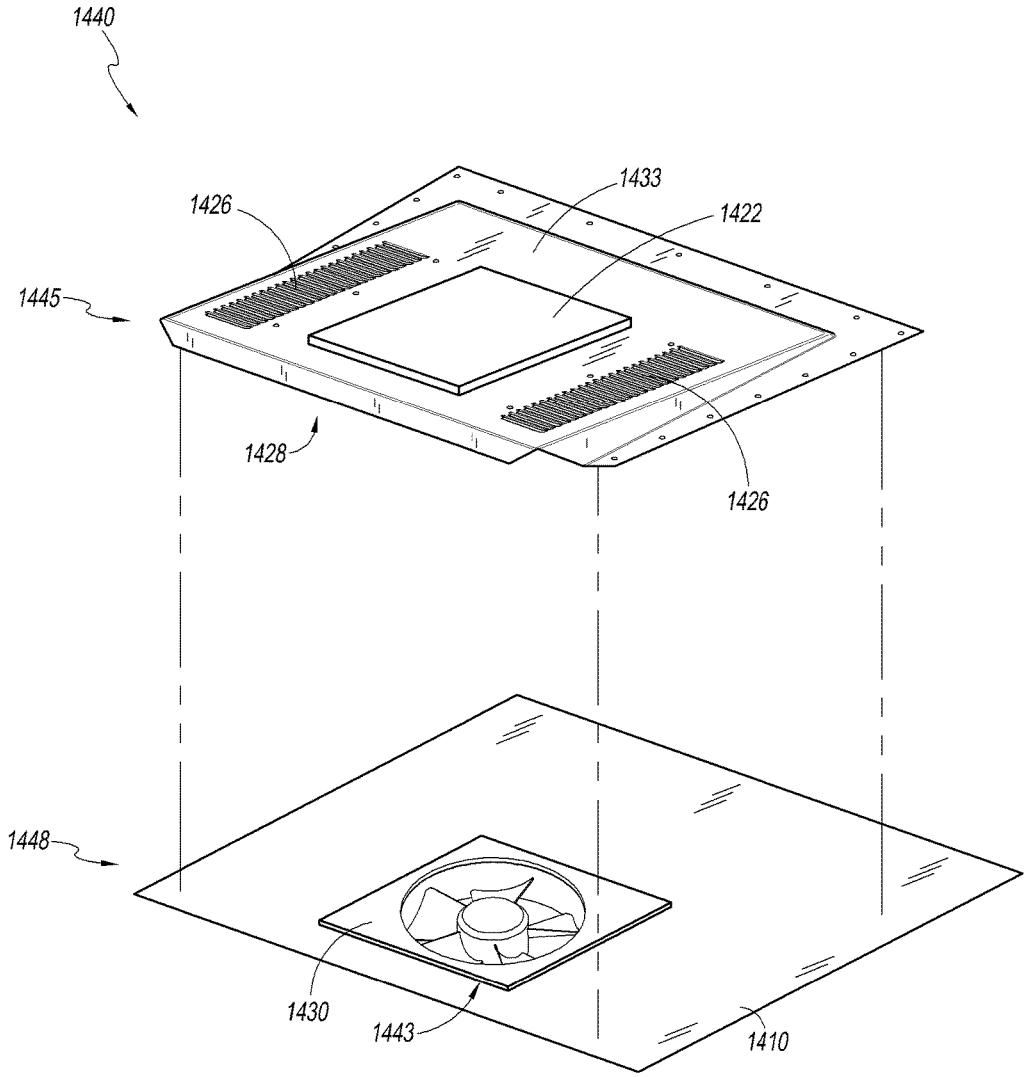
FIG. 14B is a top exploded perspective view of the tapered composition roof vent of FIG. 14A showing a vent member with an integrated fan.
Figure 14C:
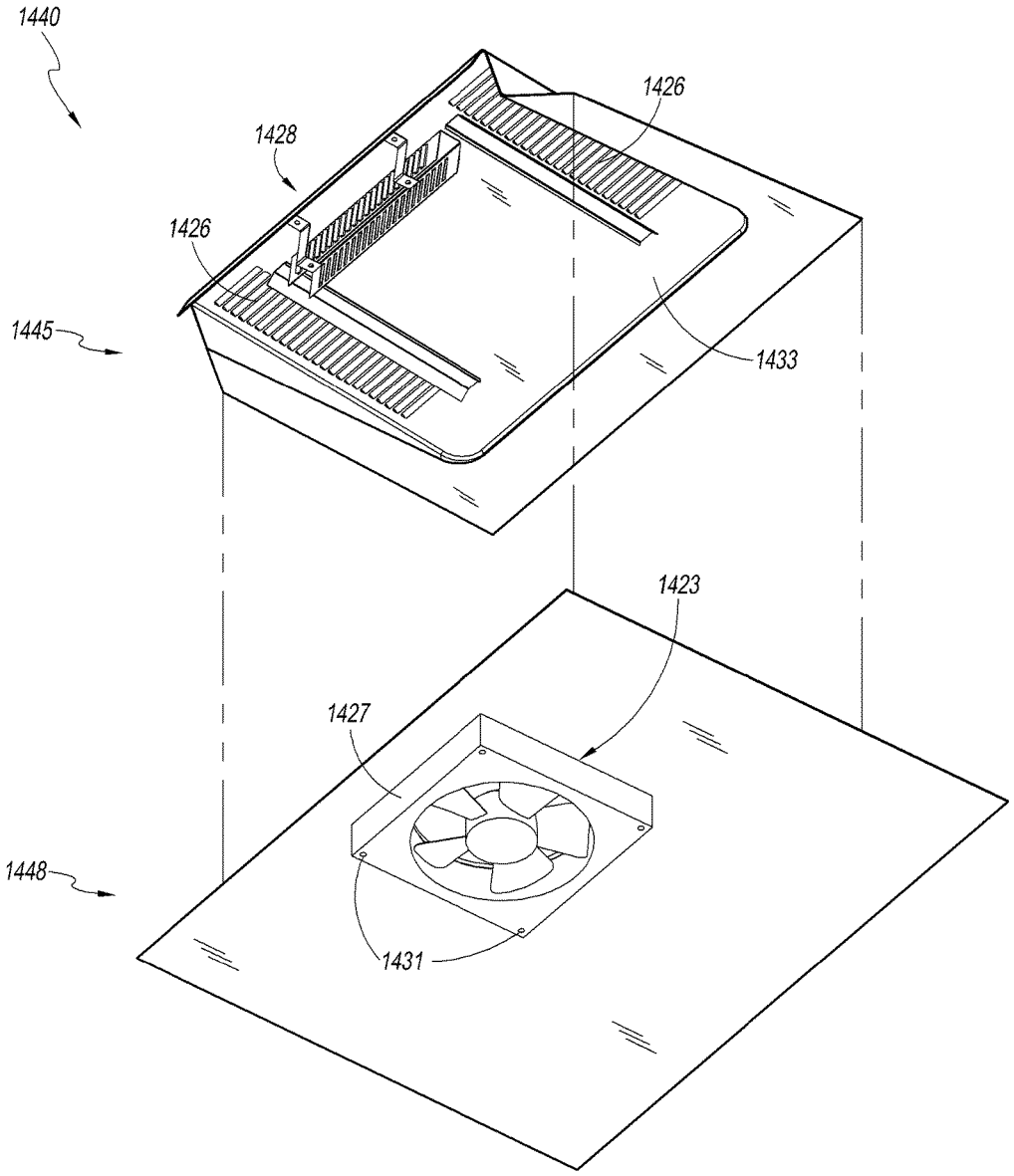
FIG. 14C is a bottom exploded perspective view of the tapered composition roof vent of FIG. 14A showing a vent member with an integrated fan.

FIGS. 14A-C show various views of an embodiment of a tapered composition roof vent 1440 with a solar panel 1422. FIG. 14A is a top perspective view of the tapered composition roof vent 1440 comprising a roof vent member 1448 and a secondary roof vent member 1445. FIG. 14B is a top exploded perspective view of the tapered composition roof vent 1440. FIG. 14C is a bottom exploded perspective view of the tapered composition roof vent 1440.

The tapered composition roof vent 1440 comprises a roof vent member 1448 and a secondary roof vent member 1445 positioned above the roof vent member 1448. The secondary roof vent member 1445 may be coupled with the vent member 1448 and/or with various components of the roof, such as the roof deck (not shown). The roof vent member 1448 has an integrated fan assembly 1443, and the secondary roof vent member 1445 can have the solar panel 1422 attached thereto. The roof vent member 1448 can include complementary fastening elements 1431 (FIG. 14C) that couple together the various components of the member 1448 in a similar fashion as described elsewhere herein, for example with respect to the vent member 343 discussed herein and shown in FIGS. 12A-12D. The roof vent member 1448 may further include an upper plate 1430 with which the fasteners (not shown) are coupled, a subflashing 1410, and the fan assembly 1443. Roof vent member 1448 can include a lower plate (not shown). The upper plate 1430, the fasteners, the complementary fastening elements 1431, the subflashing 1410 and the lower plate may have similar features and may be assembled in a similar way as described above with respect to FIGS. 12A-12D for, respectively, the upper plate 330, the fasteners 331, the complementary fastening elements 341, the subflashing 310 and the lower plate 340. Further, other sealing elements or screens, similar to the upper and lower sealing elements 320, 340 and the upper and lower screen 332, 243, may be similarly implemented with the roof vent 1440 as well.

The secondary roof vent member 1445 can include a tapered top 1433 with louver slits 1426 on its top surface and an opening 1428 on its front edge. Between the secondary roof vent member 1445 and the roof vent member 1448 is a cavity, which may include screens, baffles, or other filtering structures to cover and prevent damage to fan assembly 1443, and/or prevent injury caused by fan assembly 1443. In use, air from the attic is directed through the fan housing 1427 by the fan assembly 1423, then through a cavity between the roof vent member 1448 and the secondary roof vent member 1445, then through the louver slits 1426 and/or the opening 1428. The tapered design of the integrated vent may advantageously increase the velocity of air flowing through the vent into the building, as the tapered top acts as a kind of nozzle or flow restriction on the air inducted into the vent. It will be appreciated that air flow into the building can occur naturally or can be assisted by using the fan assembly 1438 that draws air into the building rather than exhausts air therefrom. For example, a controller can be configured to select a direction of rotation of the fan assembly 1438 based on whether it is desired to induct air into the building or exhaust air therefrom. Alternatively, the fan assembly 1438 can simply have fan blades designed to only draw air into the building. An increased air flow velocity through the vent and into the building may be particularly advantageous in some applications. In other embodiments, wherein the fan assembly 1438 is used or configured to exhaust air, the tapered design of the integrated vent reduces resistance to the exhaust of the air flow out of the building. A controller with similar function can be implemented to control the fan assemblies of the other vent members described herein.

Figure 15A:
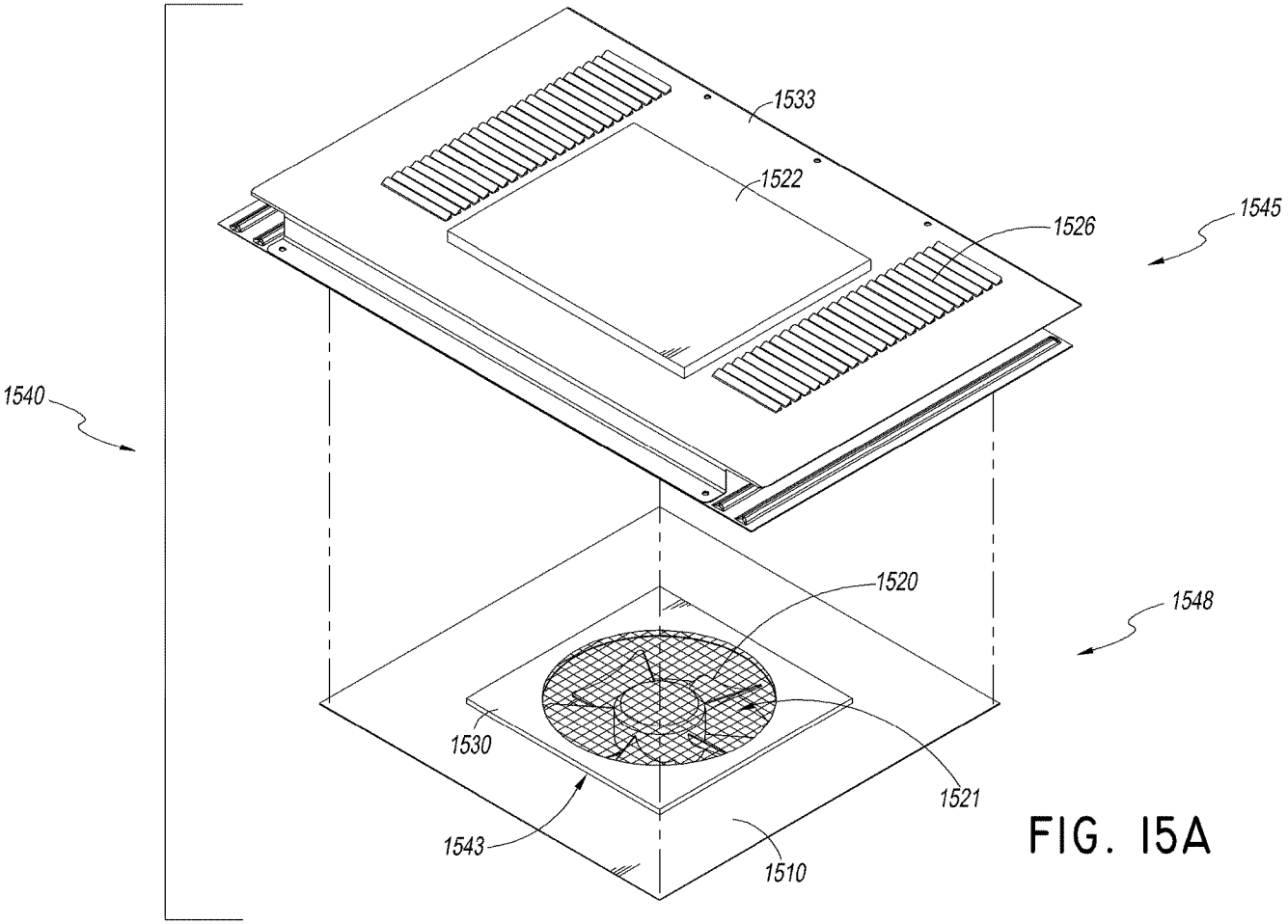
FIG. 15A is top exploded perspective view of an embodiment of a flat roof vent with a solar panel.
Figure 15B:
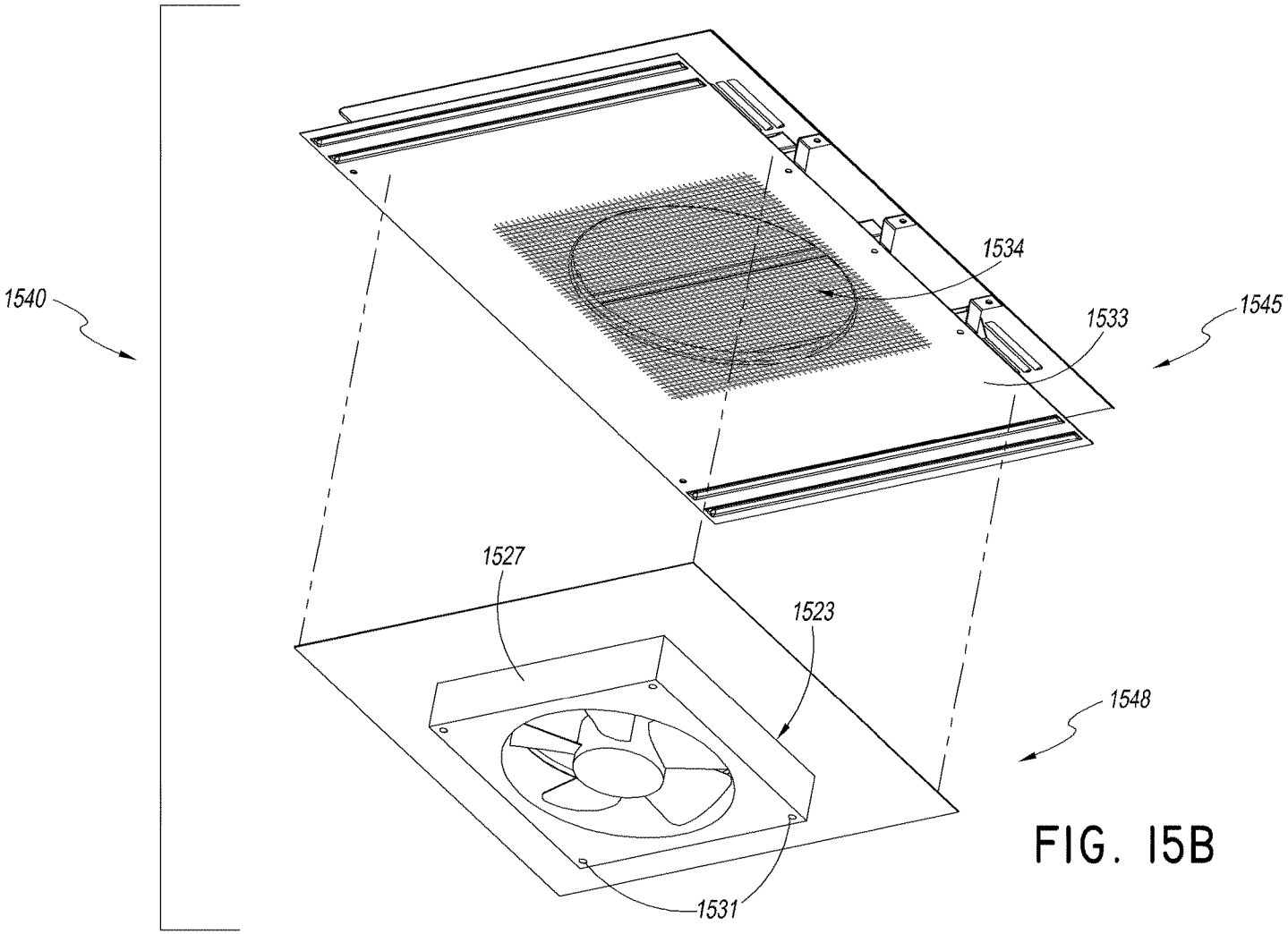
FIG. 15B is a bottom exploded perspective view of the roof vent of FIG. 15A showing a vent member with an integrated fan and a secondary roof vent member.
Figure 15C:
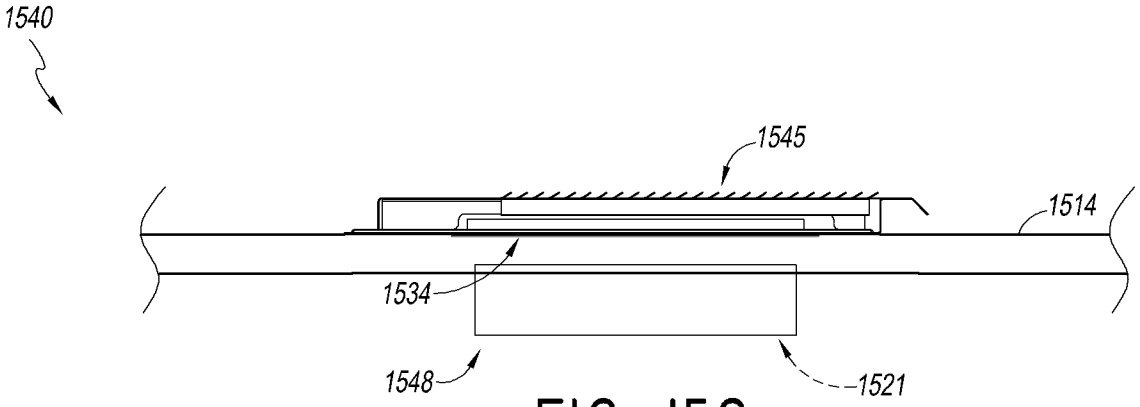
FIG. 15C-15D are side views of the roof vent of FIG. 15A showing the vent member in various lateral positions with respect to the secondary roof vent member.
Figure 15D:
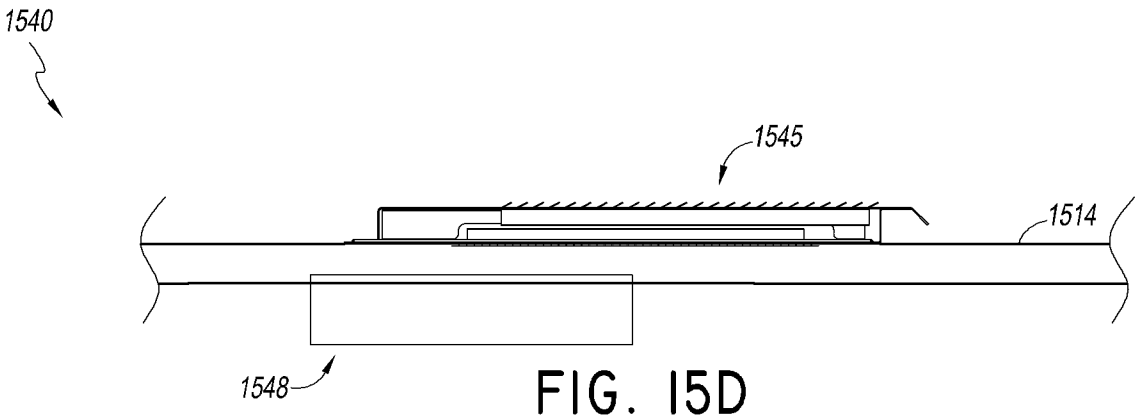

FIGS. 15A-D show various views of an embodiment of a flat roof vent 1540 with a solar panel 1522 attached thereto. FIG. 15A is a top exploded perspective view of the flat roof vent 1540. FIG. 15B is a bottom exploded perspective view of the flat roof vent 1540. FIG. 15C is a side view of the flat roof vent 1540. FIG. 15D is a side view of another embodiment of the flat roof vent 1540.

The flat roof vent 1540 comprises a roof vent member 1548 and a flat secondary roof vent member 1545 positioned above the vent member 1548. The flat secondary roof vent member 1545 may be coupled with the vent member 1548 and/or with various components of the roof, such as the roof deck (not shown). The vent member 1548 can have an integrated fan assembly 1543, an upper screen 1520. The flat secondary roof vent member 1545 can have the solar panel 1522 attached thereto. The vent member 1548 can include complementary fastening elements 1531 (FIG. 15B) that couple together the various components of the vent member 1548 in a similar fashion as described elsewhere herein, for example with respect to the vent member 343 discussed herein and shown in FIGS. 12A-12D. The vent member 1548 may further include an upper plate 1530 with which the fasteners (not shown) are coupled, a subflashing 1510, the fan assembly 1523, and a lower plate (not shown). The vent member 1548 can include a channel 1521. The upper plate 1530, the fasteners, the complementary fastening elements 1531, the subflashing 1510 and the lower plate may have similar features and may be assembled in a similar way as described above with respect to FIGS. 12A-12D for, respectively, the upper plate 330, the fasteners 331, the complementary fastening elements 341, the subflashing 310 and the lower plate 340. Further, other sealing elements or screens, similar to the upper and lower sealing elements 320, 340 and the upper and lower screen 332, 243, may be similarly implemented with the roof vent 1540 as well.

The flat secondary roof vent member 1545 can include a flat top 1533 with louver slits 1526 on its top surface. The secondary roof vent member 1545 can include an opening 1534 to allow flow therethrough. Between the flat secondary roof vent member 1545 and the vent member 1548 is a cavity, which may include screens, baffles, or other filtering structures to cover and prevent damage to fan assembly 1523, and/or prevent injury caused by fan assembly 1523. In use, air from the attic is directed through the fan housing 1527 by the fan assembly 1538, then through a cavity between the roof vent member 1548 and the secondary roof vent member 1545, then through the louver slits 1526 and/or other openings in the front of the vent. The roof vent 1540 may have similar features and functionalities as the roof vent 1440 discussed with respect to FIGS. 14A-14C.

As shown in FIGS. 15C-15D, the vent member 1548 and the secondary roof vent member 1545 may be positioned in various lateral locations relative to each other. The secondary roof vent member 1545 is shown in a first lateral position along the top side of the roof deck 1514. The vent member 1548 is shown in a second lateral position along the bottom side of the roof deck 1514. In some embodiments, the first lateral position of the secondary roof vent member 1545 is similar as the second lateral position of the vent member 1548. For instance, as shown in FIG. 15C, the vent member 1548 may be positioned substantially directly below the secondary roof vent member 1545 such that the lateral positions of channel 1521 and opening 1548 are similar, allowing approximate alignment of the two vent members, and increasing ventilation therethrough. In some embodiments, the first lateral position of the secondary roof vent member 1545 may be different from the second lateral position of the vent member 1548. As shown in FIG. 15D, the vent member 1548 may be positioned laterally offset from the secondary roof vent member 1545 such that their lateral positions of channel 1521 and opening 1548 are different. Therefore, a variety of lateral configurations may be implemented with the various components of the roof vent 1540, or with any other embodiments of the roof vent disclosed herein, including but not limited to the roof vent member 343 shown and described above with respect to FIGS. 12A-12D, when implemented with other secondary vent members.

Figure 16A:
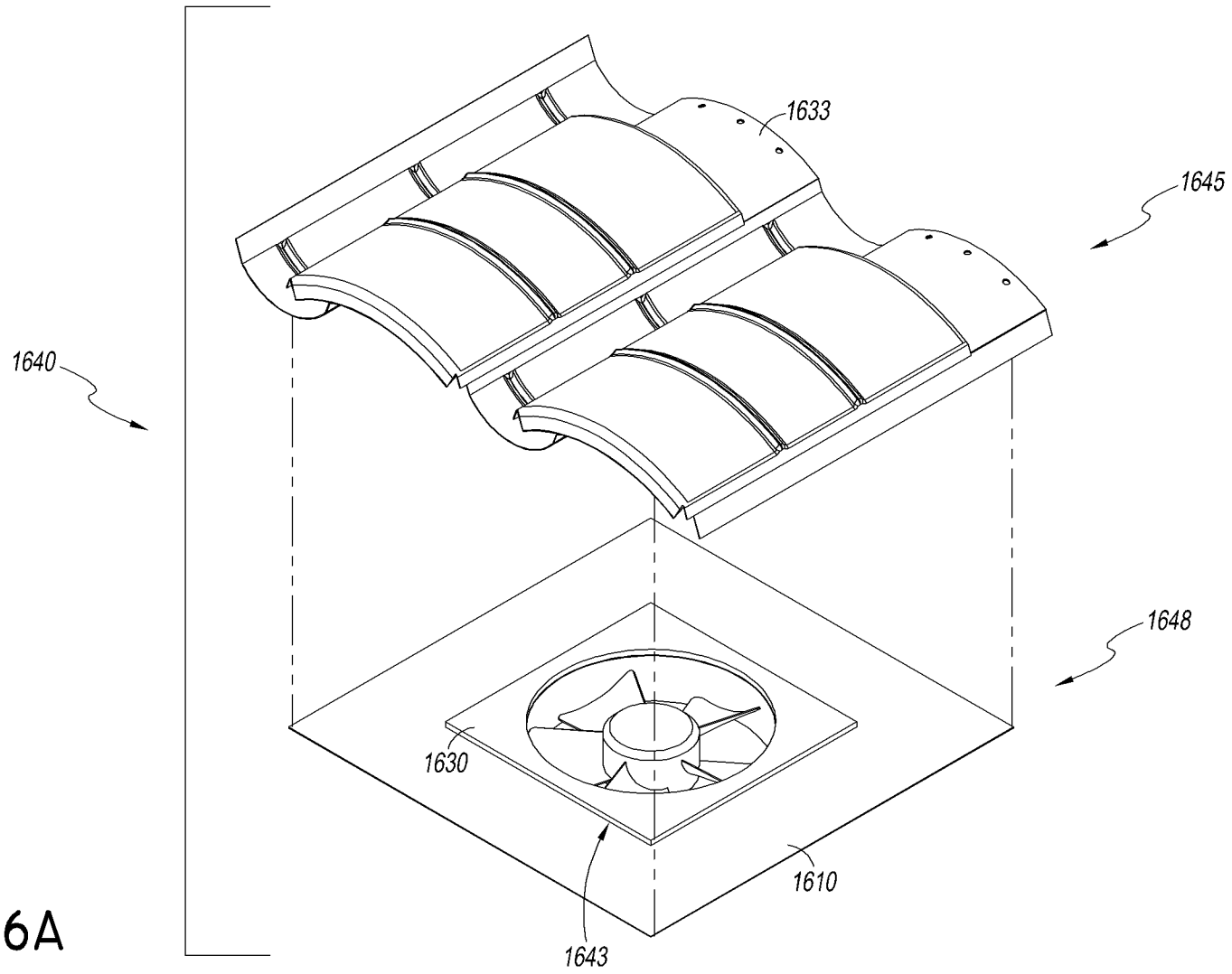
FIG. 16A is a top exploded perspective view of an embodiment of an S-vent showing a roof vent member with an integrated fan.
Figure 16B:
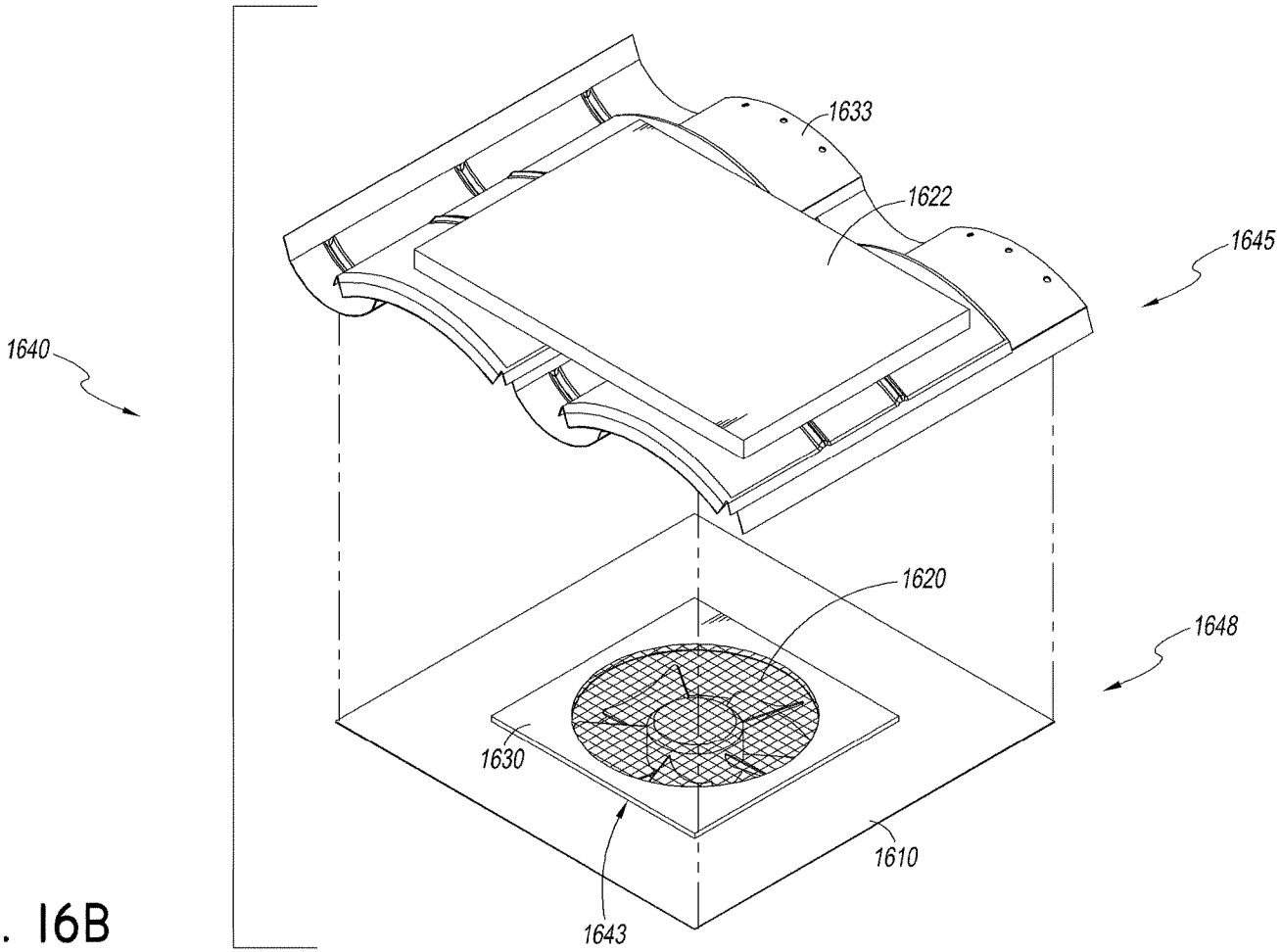
FIG. 16B is a top exploded perspective view of the S-vent of FIG. 16A with the S-shaped secondary roof vent member having a flat solar panel and the roof vent member having an integrated fan and an upper screen.
Figure 16C:
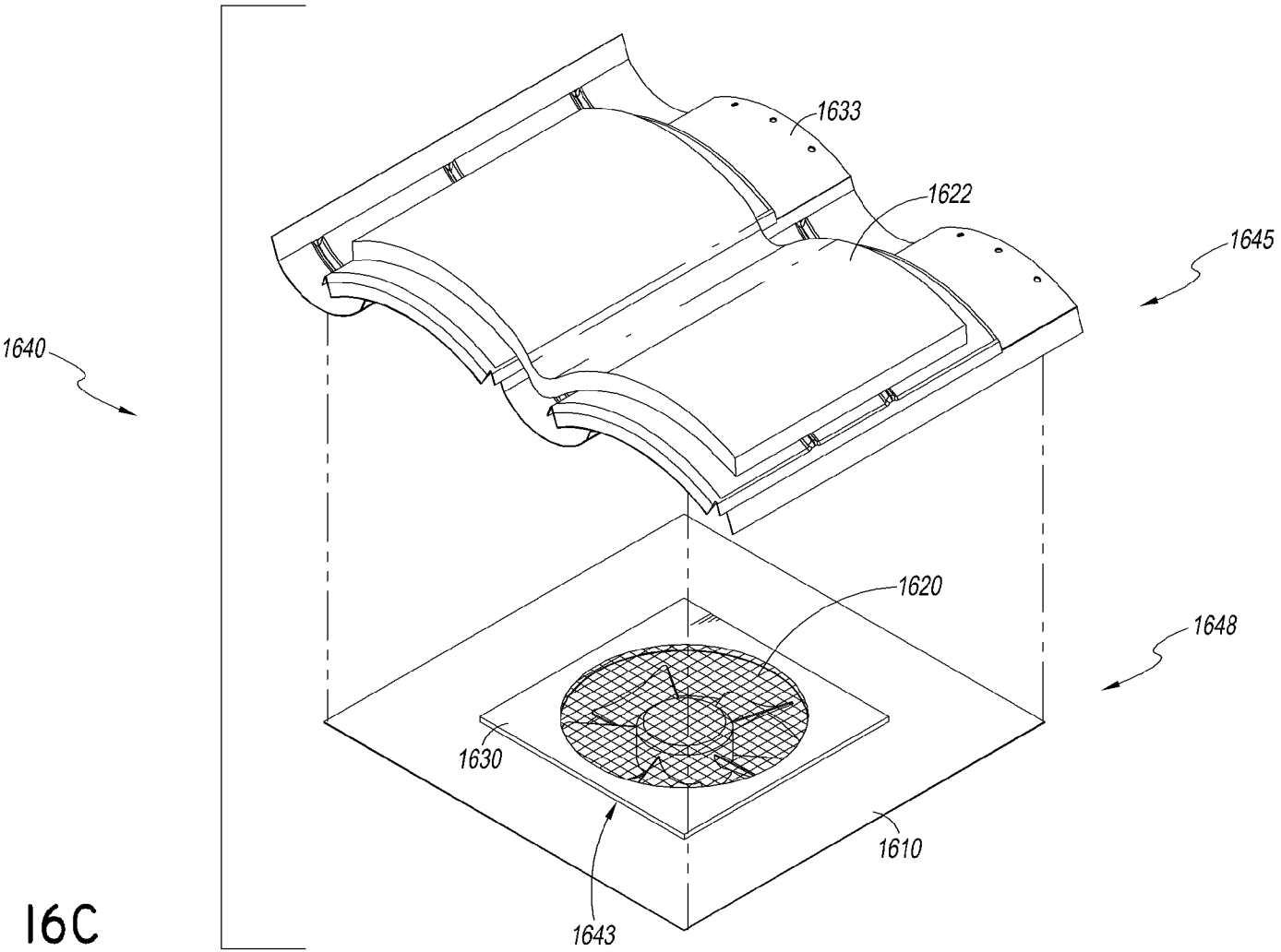
FIG. 16C is a top exploded perspective view of the S-vent of FIG. 16A with the S-shaped secondary roof vent member having a flexible solar panel and the roof vent member having an integrated fan and an upper screen.
Figure 16D:
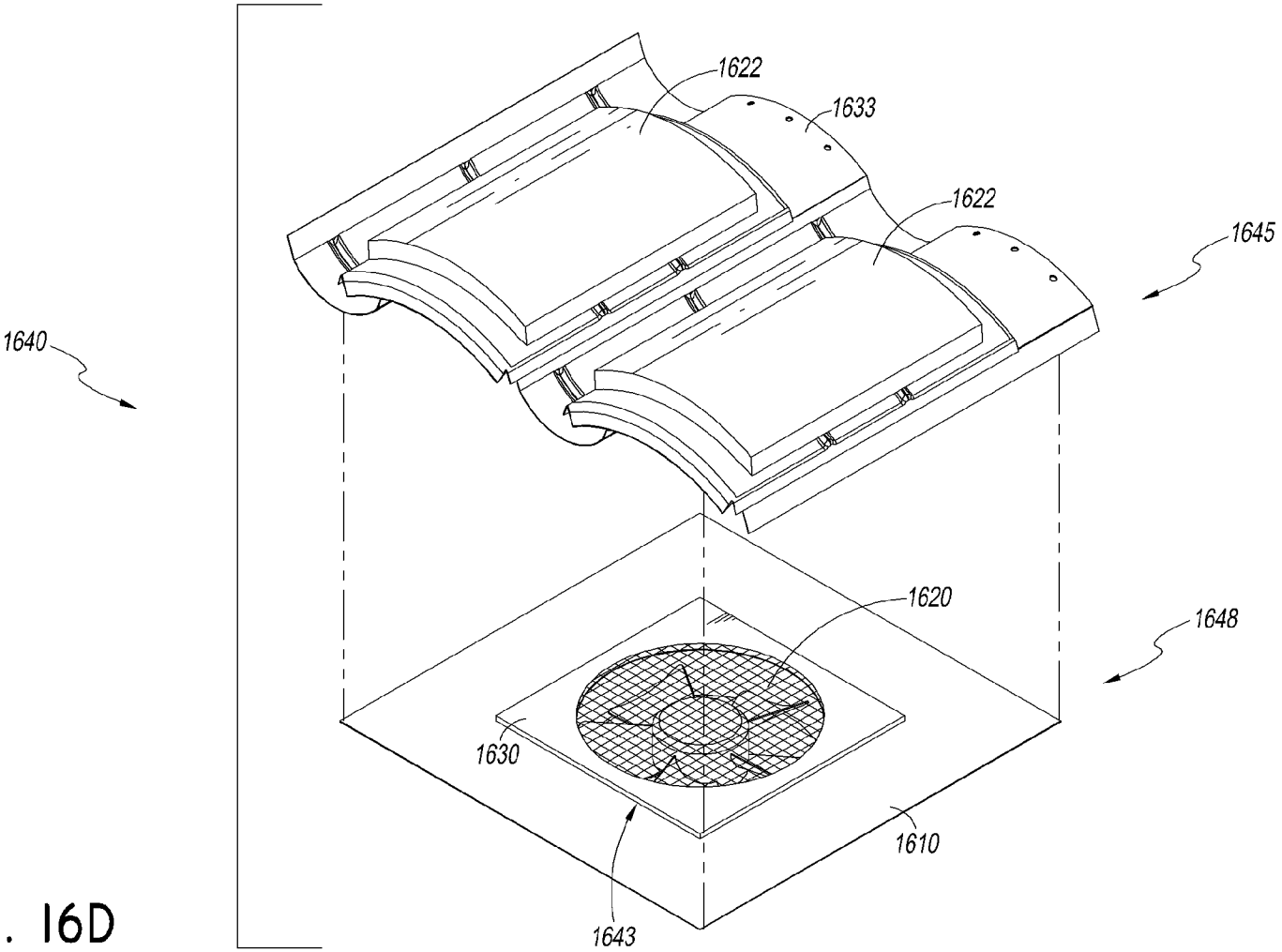
FIG. 16D is a top exploded perspective view of the S-vent of FIG. 16A with the S-shaped secondary roof vent member having multiple flexible solar panels and the roof vent member having an integrated fan and an upper screen.
Figure 16E:
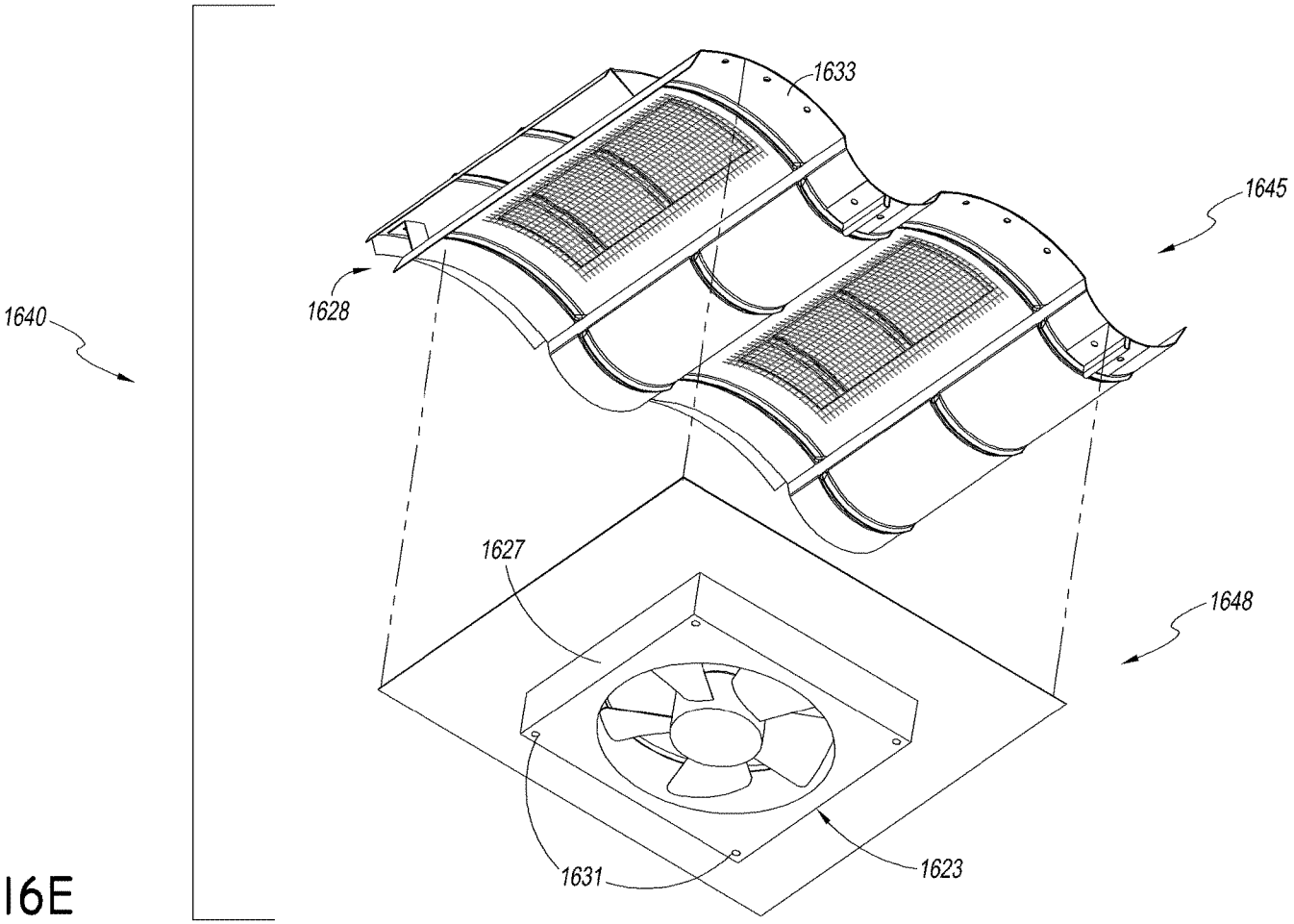
FIG. 16E is a bottom exploded perspective view of the S-vent of FIG. 16A showing the roof vent member with the integrated fan assembly.

FIGS. 16A-E show various views of an embodiment of an S-shaped roof vent or S-vent 1640. FIG. 16A is a top exploded perspective view of the S-vent 1640. FIGS. 16B-16D are top exploded perspective views of the S-vent 1640 with various embodiments of a solar panel 1622 attached thereto. FIG. 16B shows the S-vent 1640 with a flat solar panel 1622, FIG. 16C shows the S-vent 1640 with a curved (e.g., flexible) solar panel 1622, and FIG. 16D shows the S-vent 1640 with multiple curved (e.g., flexible) solar panels 1622. FIG. 16E is a bottom exploded perspective view of the S-vent 1640.

The S-vent 1640 comprises a vent member 1648 and an S-shaped secondary roof vent member 1645 positioned above the vent member 1648. The S-shaped secondary roof vent member 1645 may be coupled with the vent member 1648 and/or with various components of the roof, such as the roof deck (not shown). The vent member 1648 has an integrated fan assembly 1643. In the embodiments shown in FIGS. 16B-16D, the secondary vent member 1645 has the solar panel 1622 attached thereto. The embodiment shown in FIG. 16E may have the solar panel 1622 attached to the secondary vent member 1645. The vent member 1648 can include complementary fastening elements 1531 (FIG. 16E) that couple together the various components of the vent member 1648 in a similar fashion as described elsewhere herein, for example with respect to the vent member 343 discussed herein and shown in FIGS. 12A-12D. The vent member 1648 may further include an upper plate 1630 with which the fasteners (not shown) are coupled, a subflashing 1610, the fan assembly 1623, and a lower plate (not shown). The upper plate 1630, the fasteners, the complementary fastening elements 1631, the subflashing 1610 and the lower plate may have similar features and may be assembled in a similar way as described above with respect to FIGS. 12A-12D for, respectively, the upper plate 330, the fasteners 331, the complementary fastening elements 341, the subflashing 310 and the lower plate 340. Further, other sealing elements and/or screens, similar to the upper and lower sealing elements 320, 340 and the upper and lower screen 332, 243, may be similarly implemented with the roof vent 1640 as well. For instance, as shown in FIGS. 16B-16D, the vent member 1648 includes an upper screen 1620.

The secondary roof vent member 1645 can include an S-shaped top 1633 and one or more openings 1628 (FIG. 16E) on one or more edges thereof. Between the secondary roof vent member 1645 and the roof vent member 1648 is a cavity, which may include screens, baffles, or other filtering structures to cover and prevent damage to fan assembly 1643, and/or prevent injury caused by fan assembly 1643. In use, air from the attic is directed through the fan housing 1627 by the fan assembly 1623, then through the cavity between the roof vent member 1648 and the secondary roof vent member 1645, then through the one or more openings 1628. The roof vent 1640 may have similar features and functionalities as the roof vent 1440 discussed with respect to FIGS. 14A-14C.

Figure 17A:
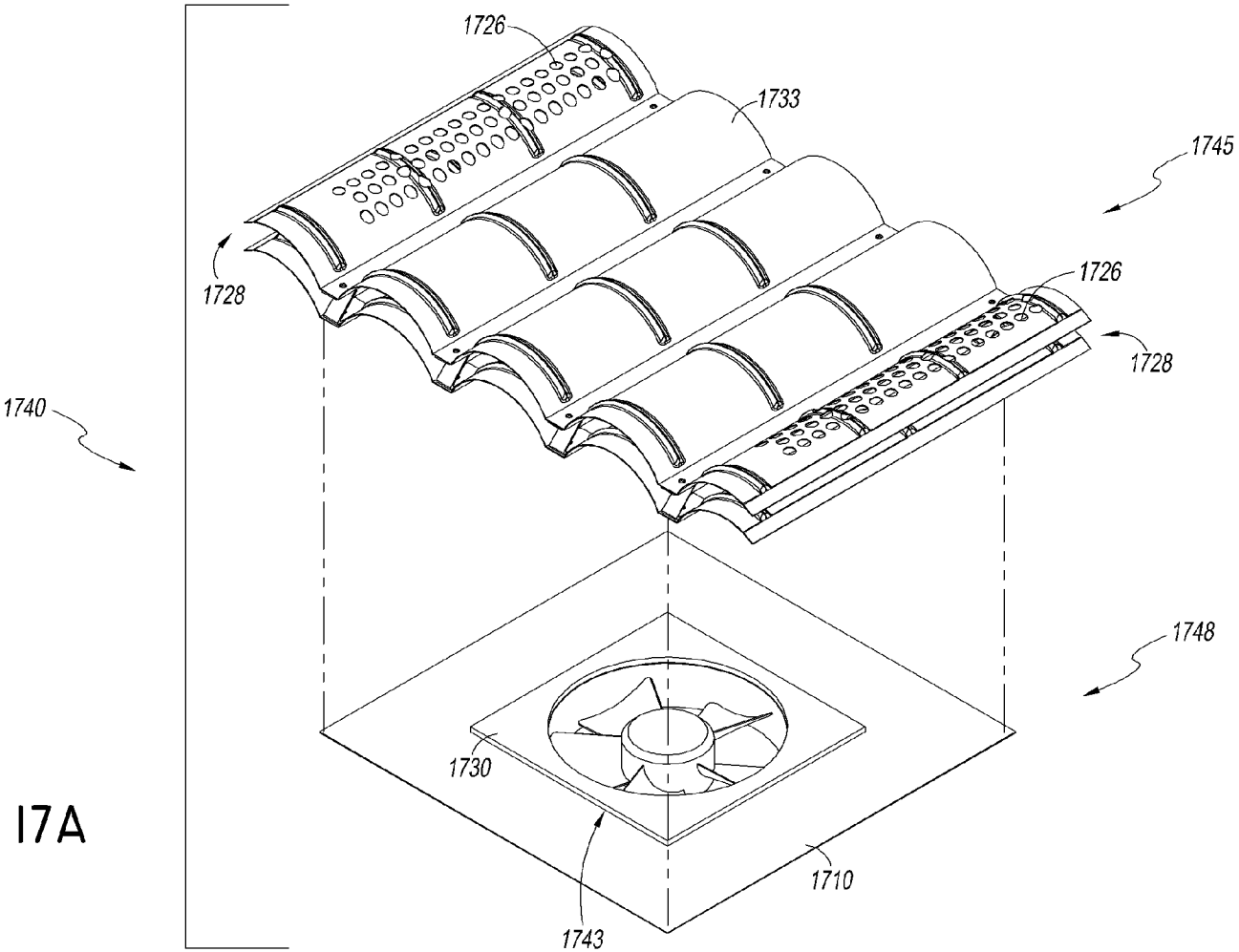
FIG. 17A is a top exploded perspective view of an embodiment of an M-vent showing the vent member with an integrated fan assembly and an M-shaped secondary roof vent member.
Figure 17B:
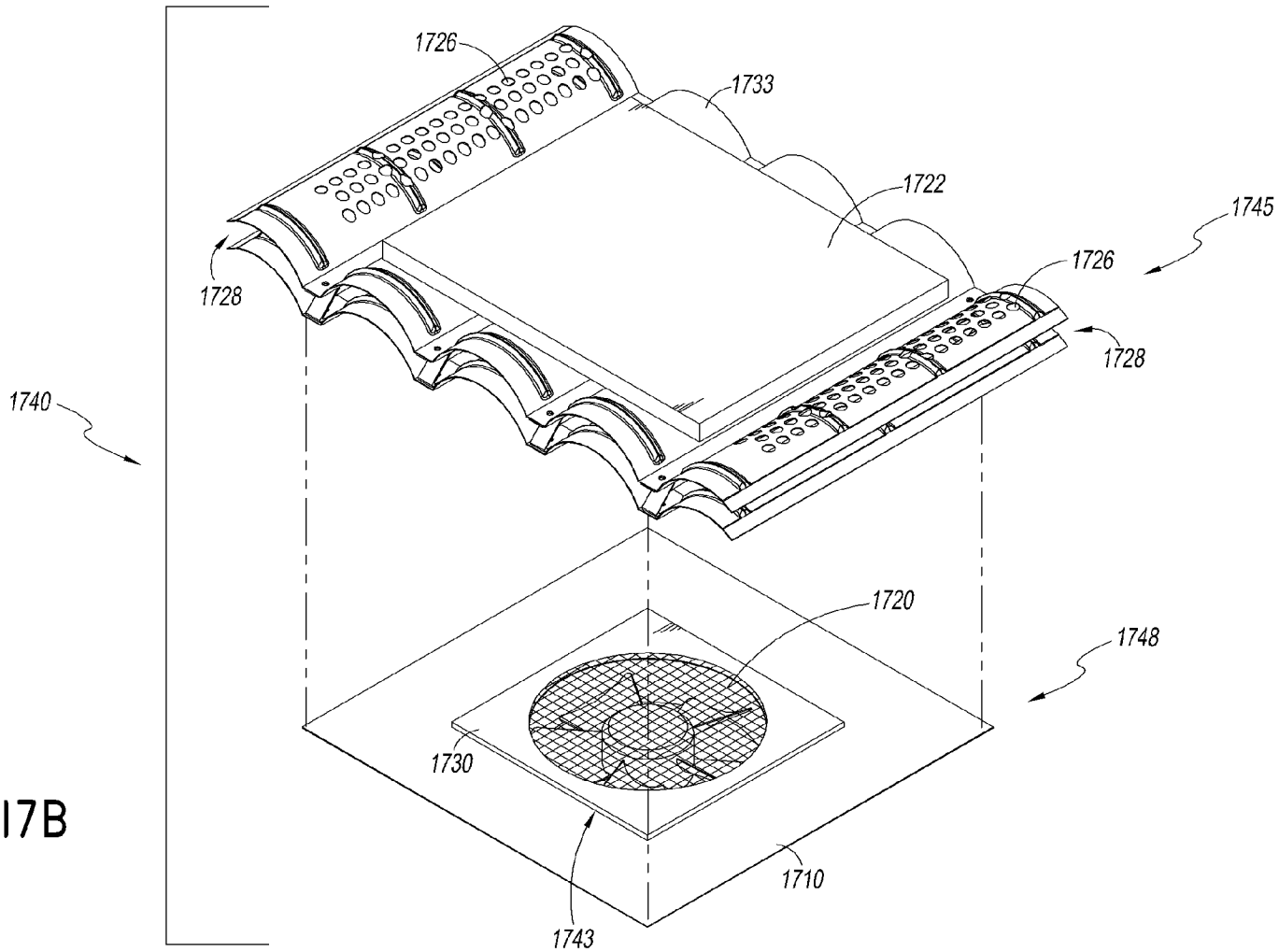
FIG. 17B is a top exploded perspective view of the M-vent of FIG. 17A with the M-shaped secondary roof vent member having a flat solar panel and the roof vent member having an integrated fan and an upper screen.
Figure 17C:
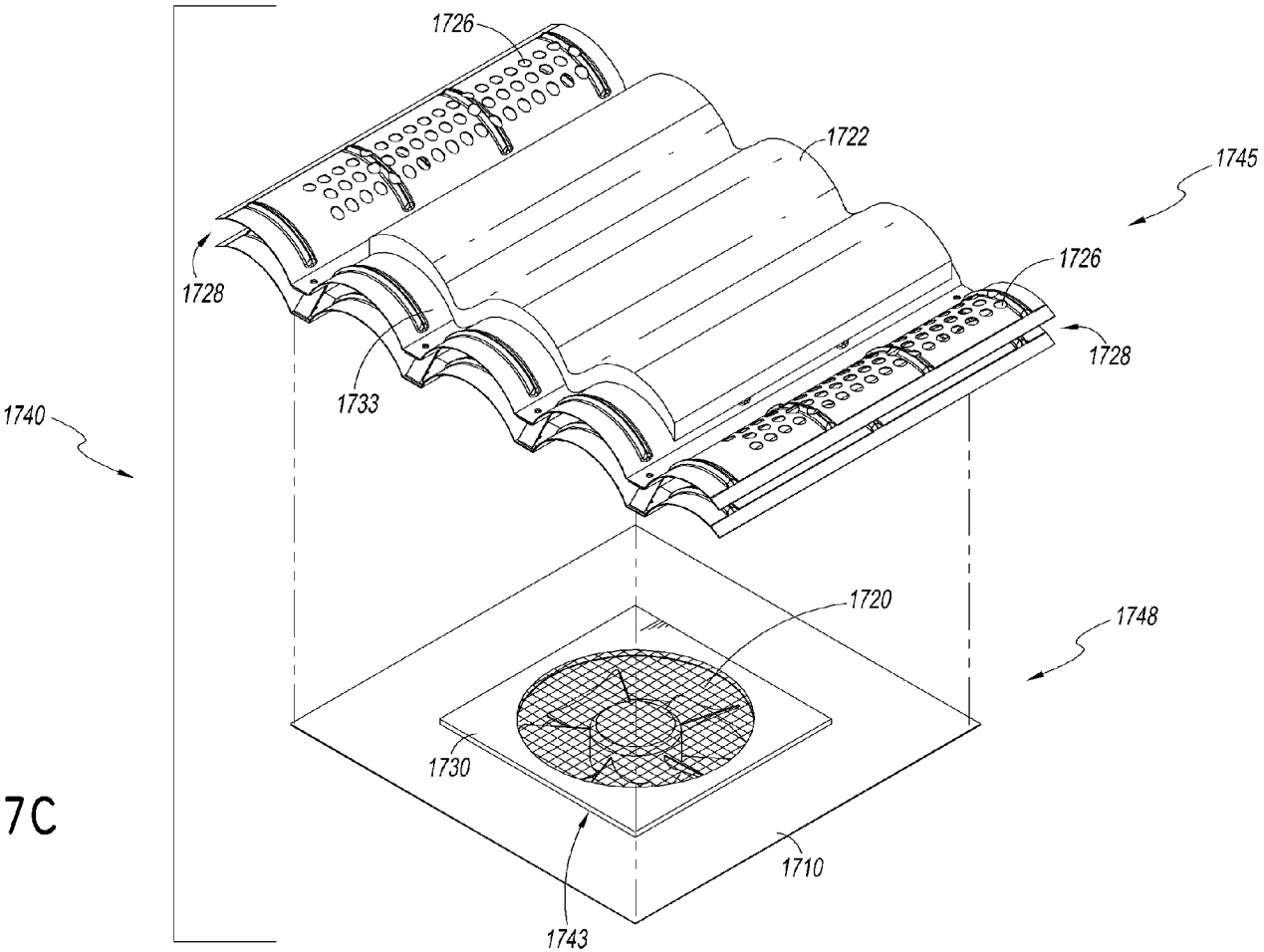
FIG. 17C is a top exploded perspective view of the M-vent of FIG. 17A with the M-shaped secondary roof vent member having a flexible solar panel and the roof vent member having an integrated fan and an upper screen.
Figure 17D:
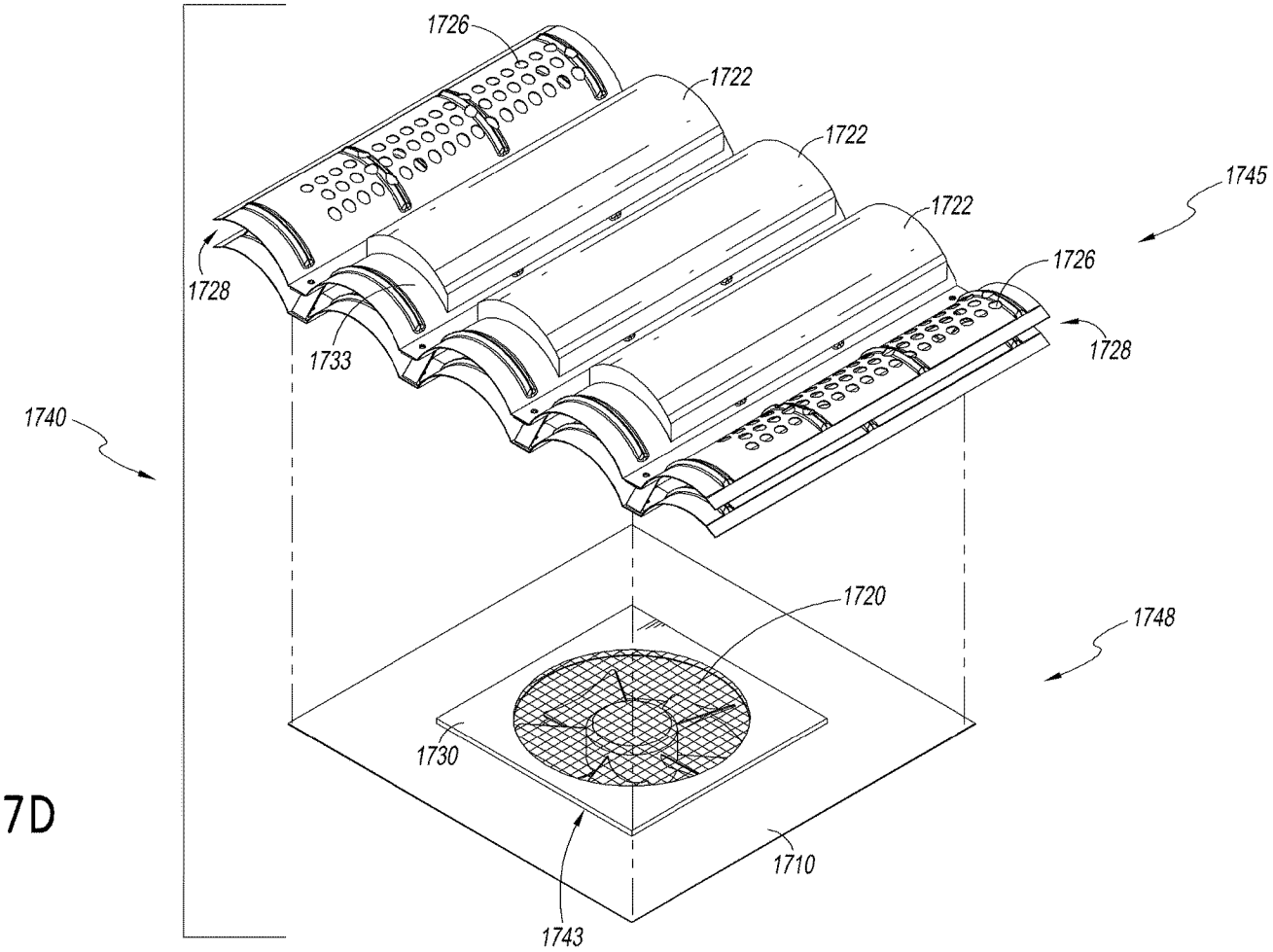
FIG. 17D is a top exploded perspective view of the M-vent of FIG. 17A with the M-shaped secondary roof vent member having multiple flexible solar panels and the roof vent member having an integrated fan and an upper screen.
Figure 17E:
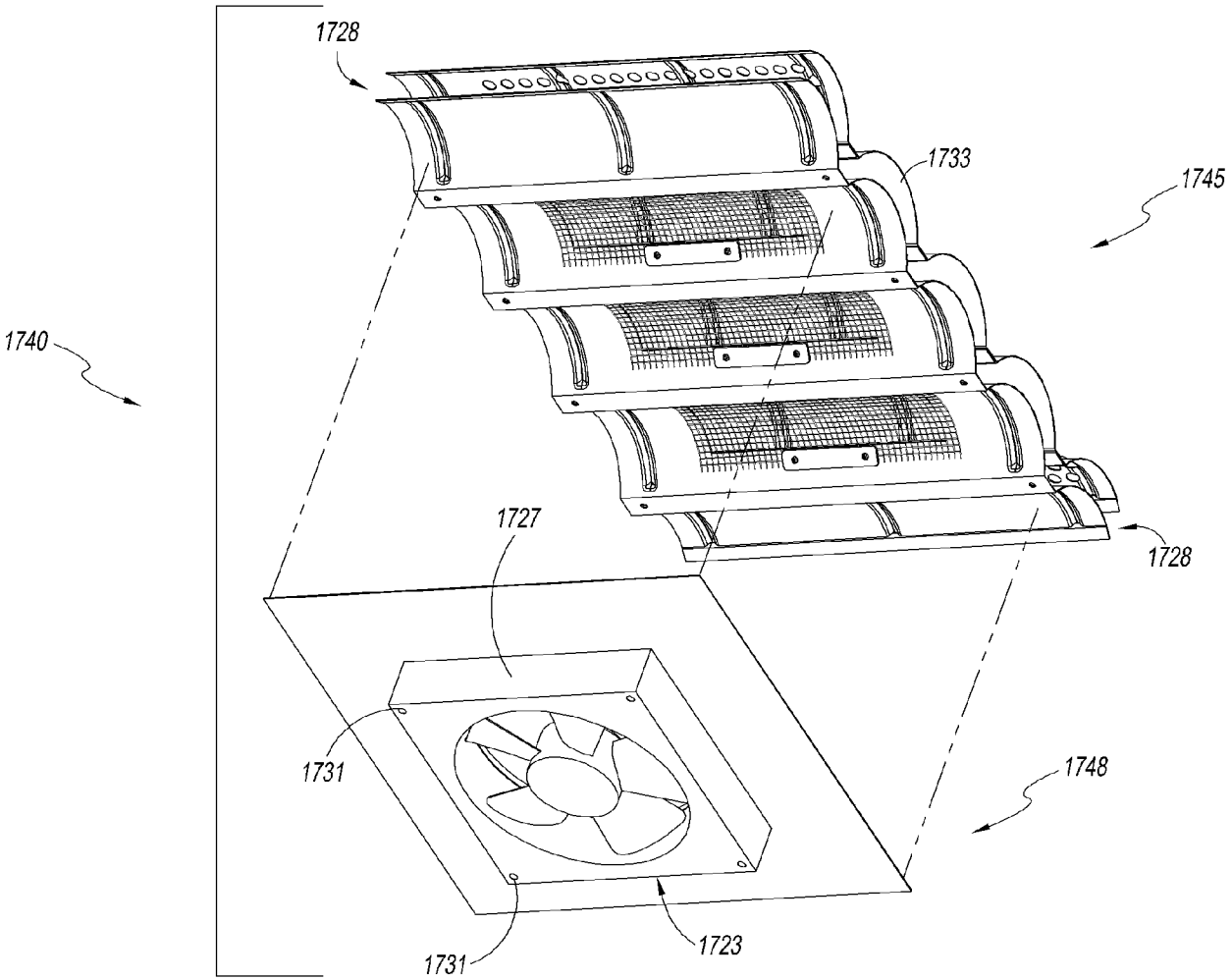
FIG. 17E is a bottom exploded perspective view of the M-vent of FIG. 17A showing the roof vent member with the integrated fan assembly.

FIGS. 17A-E show various views of an embodiment of an M-shaped roof vent or M-vent 1640. FIG. 17A is a top exploded perspective view of the M-vent 1740. FIGS. 17B-17D are top exploded perspective views of the M-vent 1740 with various embodiments of a solar panel 1722 attached thereto. FIG. 17B shows the M-vent 1740 with a flat solar panel 1722, FIG. 17C shows the M-vent 1740 with a flexible solar panel 1722, and FIG. 17D shows the M-vent 1740 with multiple flexible solar panels 1722. FIG. 17E is a bottom exploded perspective view of the M-vent 1640.

The M-vent 1740 comprises a vent member 1748 and an M-shaped secondary roof vent member 1745 positioned above the vent member 1748. The M-shaped secondary roof vent member 1745 may be coupled with the vent member 1748 and/or with various components of the roof, such as the roof deck (not shown). The vent member 1748 has an integrated fan assembly 1743. In the embodiments shown in FIGS. 17B-17D, the secondary vent member 1745 has one or more of the solar panels 1722 attached thereto. The embodiment shown in FIG. 17E may also include one or more of the solar panels 1722 attached to the secondary vent member 1745. The vent member 1748 can include complementary fastening elements 1731 (FIG. 17E) that couple together the various components of the vent member 1748 in a similar fashion as described elsewhere herein, for example with respect to the vent member 343 discussed herein and shown in FIGS. 12A-12D. The vent member 1748 may further include an upper plate 1730 with which the fasteners (not shown) are coupled, a subflashing 1710, the fan assembly 1723, and a lower plate (not shown). The upper plate 1730, the fasteners, the complementary fastening elements 1731, the subflashing 1710 and the lower plate may have similar features and may be assembled in a similar way as described above with respect to FIGS. 12A-12D for, respectively, the upper plate 330, the fasteners 331, the complementary fastening elements 341, the subflashing 310 and the lower plate 340. Further, other sealing elements and/or screens, similar to the upper and lower sealing elements 320, 340 and the upper and lower screen 332, 243, may be similarly implemented with the roof vent 1640 as well. For instance, as shown in FIGS. 17B-17D, the vent member 1748 includes an upper screen 1720.

The M-shaped secondary roof vent member 1745 can include an M-shaped top 1733 with apertures 1726 on its top surface and one or more openings 1728 along one or more edges thereof. Between the M-shaped secondary roof vent member 1745 and the roof vent member 1748 is a cavity, which may include screens, baffles, or other filtering structures to cover and prevent damage to fan assembly 1743, and/or prevent injury caused by fan assembly 1743. In use, air from the attic is directed through the fan housing 1727 by the fan assembly 1723, then through the cavity between the roof vent member 1748 and the M-shaped secondary roof vent member 1745, then through the apertures 1726 and/or through the one or more openings 1728. The roof vent 1740 may have similar features and functionalities as the roof vent 1440 discussed with respect to FIGS. 14A-14C, for example as discussed with respect to air flow into or out of the building and use of a controller to control the direction of such air flow.

Figure 18:
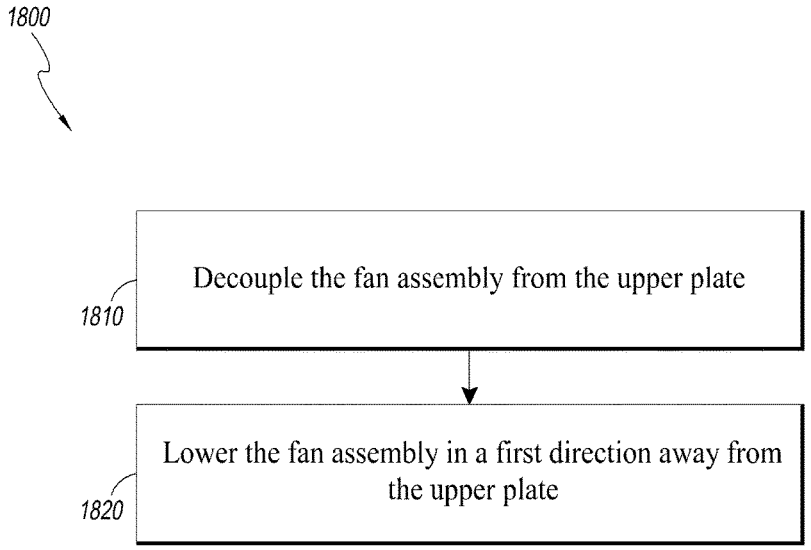
FIG. 18 is a flowchart showing an embodiment of a method for replacing various components of a roof vent member from underneath a roof deck.

FIG. 18 is a flowchart showing an embodiment of a method 1800 for removing various components of a roof vent member, such as the fan assembly, from underneath a roof deck. Some embodiments include removing the fan assembly from the remainder of the roof vent member from a position below the roof deck without decoupling the remainder of the roof vent member from the roof deck. The method 1800 may be used with various embodiments of the roof vent members discussed herein, including but not limited to the roof vent member 343.

The method 1800 begins with block 1810 wherein the fan assembly is decoupled from the upper plate of a roof vent member. The roof vent member may be the roof vent member 343, which may comprise the upper plate 330, the subflashing 310, and the fan assembly 323. In some embodiments, the roof vent member may include a lower plate, such as the lower plate 340. In some embodiments of block 1810, the roof vent member may further include either or both of the upper screen 320 and the lower screen 324.

In some embodiments, block 1810 may include decoupling either or both of the lower plate and the fan assembly from the upper plate. This may include, for example, removing complementary fastening elements 341 from fasteners 331 of the upper plate 330 such that the lower plate 340 and/or the fan assembly 323 may be removed. In some embodiments of block 1830, the complementary fastening elements 341 are nuts or bolts that are rotated to dis-engage from external or internal threads, respectively, of the fasteners 331.

The method 1800 next moves to block 1820 wherein the fan assembly is lowered in a first direction away from the upper plate. In some embodiments, block 1820 may include lowering the fan assembly from below the roof deck and away from the upper plate. This may include, for example, lowering the fan assembly 323 from the upper plate 330, while under the roof deck, such that the fasteners 331 are removed from the access holes 325 in the fan housing 327. Block 1820 may further include moving the fan assembly from a first position in which at least a first portion of the fan assembly is laterally surrounded by the roof deck opening, to a second position in which the portion of the fan assembly is not laterally surrounded by the roof deck opening. For instance, the fan assembly 323 may be lowered from a first position in which at least a first portion of the fan assembly 323 is laterally surrounded by the roof deck opening 58, to a second position in which the portion of the fan assembly 323 is not laterally surrounded by the roof deck opening 58.

In some embodiments, block 1820 may include lowering the lower plate from below the roof deck and away from the upper plate. This may include, for example, lowering the lower plate 340 from the upper plate 330, while under the roof deck, such that the fasteners 331 are completely removed from the access holes 345 in the lower plate 340.

In some embodiments, the method 1800 may include replacing the fan assembly from below the roof deck with a replacement fan assembly. The replacement fan assembly can be the same fan assembly (perhaps after it has been inspected, and found in good condition), the same fan assembly, but repaired or modified, or a different fan assembly, such as a new fan assembly. A replacement fan assembly may be raised from below the roof deck and toward the upper plate. This may include, for example, raising the replacement fan assembly 323 from below the roof deck 14 and toward the upper plate 330, such that the fasteners 331 are received in the access holes 325 of the fan housing 327. Block 1880 may further include raising the fan assembly such that corresponding distal ends of the fasteners extend into at least a portion of the fan housing. For instance, the fan assembly 323 may be raised such that corresponding distal ends of the fasteners 331 extend into at least a portion of the fan housing 327. The fan assembly 323 may be pressed against other features of the roof vent member, such as the upper sealing element 320, the subflashing 310, other features, or combinations thereof.

In some embodiments, the method 1800 may include coupling the roof vent member with a roof deck. This may include, for example, coupling the roof vent member 343 with the roof deck 14. This may be done from above the roof deck 14. In some embodiments, block 1810 may include coupling a secondary roof vent member or other components with the roof vent member and/or the roof deck. For example, block 1810 may include coupling the roof vent member 1448 with the roof deck 14 as well as coupling the secondary roof vent member 1445 with either or both of the roof vent member 1448 or the roof deck 14. In some embodiments, the subflashing is coupled with the roof deck 14 when it is mounted on an upper surface of the roof deck 14. The roof vent member may be coupled with the roof deck with a variety of suitable means, including but not limited to mechanically attaching with bolts or other fastening tools or bonding it with adhesive, roofing tar, mastic, other roofing attachment means, or combinations thereof.

In some embodiments, the method 1800 may include raising the lower plate from below the roof deck and toward the upper plate. This may include, for example, raising the lower plate 340 from below the roof deck 14 and toward the upper plate 330, such that the fasteners 331 are received in the access holes 345 of the lower plate 340. The lower plate may be pressed against other features of the roof vent member, such as the fan housing 327, the lower sealing element 324, other features, or combinations thereof.

In some embodiments, the method 1800 may include coupling one or both of the lower plate and the fan assembly with the upper plate. This may include, for example, coupling the lower plate 340 and/or the fan assembly 323 with the upper plate 330 by engaging complementary fastening elements 341 with distal ends of the fasteners 331. In some embodiments, the complementary fastening elements 341 are nuts or bolts that are rotated to engage with external or internal threads, respectively, of the fasteners 331.

These are just some examples of how the method 1800 may be performed. Further, other embodiments of the various components of the roof vent member may be implemented in the method 1800, including but not limited to the roof vent member 1540, the roof vent member 1640, and the roof vent member 1740.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products. For example, any of the primary and secondary vent members described herein can be provided separately, or integrated together (e.g., packaged together, or attached together) to form a single vent product. For example, and with reference to FIGS. 14A-14C, vent members 1445, 1448 can be fastened together into a single integrated vent.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A roof vent member, comprising:

a subflashing comprising a subflashing body with side members surrounding and extending radially outwardly from a subflashing opening extending through a central portion of the subflashing body, the side members configured to provide support to and allow positioning of the subflashing above a roof deck when the subflashing is mounted on an upper surface of the roof deck;

an upper plate comprising an upper plate body and an upper plate opening extending through the upper plate body, the upper plate body configured to be positioned above the subflashing when the subflashing is mounted on the upper surface of the roof deck; and a fan assembly coupled to the subflashing and upper plate such that the subflashing is interposed between the upper plate and the fan assembly, the fan assembly configured to be removed and replaced from under a roof deck when the subflashing is mounted on an upper surface of the roof deck, wherein the fan assembly comprises sidewalls, and wherein the upper plate further comprises a plurality of fasteners coupled with the upper plate body and positioned around the upper plate opening, wherein the fasteners are configured to couple the upper plate and a fan assembly with the subflashing, wherein the subflashing, upper plate and fan assembly are configured, such that when the fan assembly is coupled to the subflashing and the upper plate, and the subflashing is mounted on the upper surface of the roof deck, at least a portion of the sidewalls of the fan assembly is positioned entirely within a plane created by the roof deck, and wherein the subflashing, upper plate, fan assembly and fasteners are further configured such that the fasteners extend through the roof deck opening when the subflashing is mounted on the upper surface of the roof deck.

2. The roof vent member of claim 1, wherein the fasteners are configured to extend through access holes in the subflashing body and through access holes in a fan housing of the fan assembly.

3. The roof vent member of claim 1, wherein the subflashing opening and the upper plate opening are configured to align and form a ventilation channel when the subflashing and the upper plate are coupled together.

4. The roof vent member of claim 1, wherein the subflashing body is substantially planar.

5. The roof vent member of claim 1, wherein the subflashing comprises a lip projecting upwardly from the subflashing body, the lip forming a perimeter around the subflashing opening.

6. The roof vent member of claim 1, wherein the side members collectively comprise a substantially continuous flange surrounding and extending radially outwardly from the subflashing opening.

7. A roof vent comprising:

the roof vent member of claim 1; and a secondary vent member, wherein the secondary vent member is configured to be positioned above the roof vent member.

8. The roof vent of claim 7, wherein the secondary vent member is configured to couple with the roof vent member.

9. The roof vent of claim 7, wherein the secondary vent member is configured to couple with the roof deck.

10. The roof vent of claim 7, wherein the roof vent is one of a composition vent, a flat vent, an S-shaped roof vent, and an M-shaped roof vent.

11. The roof vent of claim 7, further comprising a solar panel coupled with the secondary vent member.

12. A roof vent member, comprising:

an upper plate comprising:

an upper plate body having a lower surface;

a first opening extending through the upper plate body; and a plurality of fasteners positioned around the first opening and projecting generally downward from the lower surface;

a subflashing comprising:

a subflashing body comprising a plurality of side members;

a second opening extending through a central portion of the subflashing body, the plurality of side members surrounding and extending radially outwardly from the second opening; and a first plurality of access holes extending through the side members around the second opening, wherein the side members are configured to provide support to and allow positioning of the subflashing above a roof deck when the subflashing is mounted on an upper surface of the roof deck, and wherein the upper plate body is configured to be positioned above the subflashing when the subflashing is mounted on the upper surface of the roof deck; and a fan assembly comprising a fan, fan housing including sidewalls, and a motor, wherein a second plurality of access holes extend through the fan housing, wherein the fasteners of the upper plate extend through the first plurality of access holes of the side members and the second plurality of access holes of the fan assembly to couple the upper plate and the fan assembly to the subflashing, with the subflashing positioned between the upper plate and the fan assembly, wherein the subflashing, upper plate and fan assembly are configured, such that when the fan assembly is coupled to the subflashing and the upper plate, and the subflashing is mounted on the upper surface of the roof deck, at least a first portion of the sidewalls of the fan housing of the fan assembly is positioned entirely within a roof deck opening in a plane of the roof deck and wherein the upper plate, the subflashing, the fan assembly, and the plurality of fasteners are further configured such that the plurality of fasteners extend through the roof deck opening when the subflashing is mounted on an upper surface of the roof deck.

13. The roof vent member of claim 12, wherein the plurality of fasteners are of a unitary construction with respect to the upper plate body.

14. The roof vent member of claim 12, further comprising a plurality of complementary fastening elements configured to removeably attach to distal ends of the fasteners to couple the upper plate, the subflashing and the fan housing.

15. The roof vent member of claim 12, wherein the upper plate, the subflashing, and the fan assembly are further configured to allow the fan assembly to be removed and replaced from under the roof deck when the subflashing is mounted on the upper surface of the roof deck.

16. The roof vent member of claim 12, further comprising:

a lower plate comprising:

a lower plate body;

a third opening extending through the lower plate body; and a third plurality of access holes extending through the lower plate body around the third opening, wherein the lower plate, the upper plate, the subflashing, and the fan assembly are configured to allow the fasteners to further extend through the third plurality of access holes, to couple the lower plate with the subflashing, with the lower plate positioned under the fan assembly.

17. The roof vent member of claim 16, further comprising at least one sealing element configured to be positioned and form a seal between at least one of the subflashing and the fan assembly, and the fan assembly and the lower plate.

18. The roof vent member of claim 16, further comprising at least one screen configured to cover at least one of the first opening of the upper plate and the third opening of the lower plate.

19. The roof vent member of claim 16, wherein the first opening, the second opening and the third opening are configured to form a ventilation channel with a substantially non-frustoconical shape.

20. The roof vent member of claim 19, wherein the ventilation channel has at least one of an approximately uniform cross-sectional size and shape along its length.

21. A method for removing a fan assembly from a roof deck having one or more roof vent members mounted to an upper surface of the roof deck to allow fluid communication through a roof deck opening extending through the roof deck, each roof vent member comprising an upper plate, a subflashing and a fan assembly, wherein the subflashing is positioned above the roof deck and between and coupled with the upper plate and fan assembly, the method comprising:

removing the fan assembly from the remainder of the roof vent member from a position below the roof deck without decoupling the remainder of the roof vent member from the roof deck, wherein removing comprises:

decoupling the fan assembly from the upper plate, wherein decoupling the fan assembly from the upper plate comprises decoupling a fastener that extends through the roof deck opening; and lowering the fan assembly in a first direction away from the upper plate, wherein lowering the fan assembly comprises moving the fan assembly from a first position in which at least a first portion of sidewalls of the fan assembly is laterally surrounded by the roof deck opening in a plane of the roof deck, to a second position in which the first portion of the fan assembly is not laterally surrounded by the roof deck opening.

22. The method of claim 21, wherein the roof vent member further comprises a lower plate coupled with the fan assembly, and wherein removing the fan assembly comprises decoupling the lower plate from the fan assembly.

23. The method of claim 21, further comprising replacing the fan assembly from below the roof deck with a replacement fan assembly, wherein replacing comprises:

raising the replacement fan assembly in a second direction, wherein the second direction is opposed to the first direction;

moving the replacement fan assembly to the first position; and coupling the fan assembly to the upper plate.

24. The method of claim 23, wherein at least a second portion of the fan assembly extends below a lower surface of the roof deck when the fan assembly is in the first position.

25. The method of claim 23, wherein coupling the fan assembly to the upper plate comprises:

receiving and one or more fasteners coupled with the upper plate through one or more access holes in a fan housing of the replacement fan assembly such that a corresponding distal end of the one or more fasteners extend into at least a portion of the fan housing; and removably coupling one or more complementary fastening elements to the one or more fasteners to secure together the upper plate, the subflashing and the replacement fan assembly.

* * * * *